US006462725B1

(12) United States Patent
Orisaka

(10) Patent No.: US 6,462,725 B1
(45) Date of Patent: Oct. 8, 2002

(54) LIQUID CRYSTAL DISPLAY DEVICE

(75) Inventor: Yukihisa Orisaka, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/549,341

(22) Filed: Apr. 13, 2000

(30) Foreign Application Priority Data

Jul. 14, 1999 (JP) ..... 11-200638

(51) Int. Cl.[7] ..... G09G 3/36
(52) U.S. Cl. ..... 345/98; 345/100; 345/211
(58) Field of Search ..... 345/87, 88, 89, 345/90, 91, 92, 93, 98, 99, 100, 211, 212, 213

(56) References Cited

U.S. PATENT DOCUMENTS 5,325,411 A 6/1994 Orisaka
5,666,133 A * 9/1997 Mastsuo et al. ..... 345/100
5,696,978 A * 12/1997 Nishikawa ..... 345/212
5,745,090 A * 4/1998 Kim et al. ..... 345/90
5,784,039 A * 7/1998 Yasui et al. ..... 345/90
5,828,357 A 10/1998 Tamai
5,940,055 A * 8/1999 Lee ..... 345/92
6,002,384 A 12/1999 Tamai et al.

FOREIGN PATENT DOCUMENTS

JP A3177890 8/1991
JP A10274783 10/1998

* cited by examiner

*Primary Examiner*—Xiao Wu

(57) ABSTRACT

An active-matrix-type liquid crystal display device is made up of a liquid crystal panel, a gate driver including a switching circuit, a source driver, a control circuit, a power circuit, a counter electrode driving circuit, etc. Upon application of a voltage VDD, the switching circuit outputs to an output circuit a voltage VDD for ON of TFT elements, and a voltage VSS for OFF of the TFT elements. Upon application of a voltage VSS, however, the switching circuit outputs to the output circuit a voltage VDD for ON of the TFT elements, and a voltage of a rectangular wave signal ACK for OFF of the TFT elements. Consequently, the liquid crystal display device, using a single gate driver, can perform driving of gate signal lines in accordance with the structure of the liquid crystal panel (Cs-on-common or Cs-on-gate).

10 Claims, 20 Drawing Sheets

LIQUID CRYSTAL DISPLAY DEVICE

FIELD OF THE INVENTION

The present invention relates to a liquid crystal display device, and in particular to a liquid crystal display device provided with a gate driver compatible with both the so-called Cs-on-common structure and the so-called Cs-on-gate structure.

BACKGROUND OF THE INVENTION

Conventionally, liquid crystal display devices using the active matrix driving method, provided with TFT (thin-film transistor) elements as switching elements for selective driving of pixel electrodes, are known (see Japanese Unexamined Patent Publication Nos. 3-177890/1991 (Tokukaihei 3-177890, published on Aug. 1, 1991) and 10-274783/1998 (Tokukaihei 10-274783, published on Oct. 13, 1998). Structures for a liquid crystal panel provided in such a liquid crystal display device include the so-called Cs-on-common and Cs-on-gate structures.

As shown in FIG. 15, a liquid crystal display device 101 provided with a liquid crystal panel 102 having a Cs-on-common structure includes a gate driver 103, a source driver 104, a control circuit 105, a power circuit 106 which is a power source for the liquid crystal driving system, and a counter electrode driving circuit 107. The liquid crystal panel 102 includes a plurality of gate electrode lines 108 and source electrode lines 109, extending in intersecting directions on an insulating substrate, and is driven by the active matrix driving method. In the vicinity of the areas where the respective gate and source signal lines 108 and 109 cross, the liquid crystal panel 102 is provided with pixel electrodes, TFT elements, liquid crystal capacitances, auxiliary capacitances, etc., which are structures necessary for display operations. Auxiliary capacitance electrodes are connected to a capacitance line (connected in turn to a counter electrode line connected to the counter electrode), and are all fixed at a common potential.

The counter electrode driving circuit 107 supplies a counter electrode signal AC to the counter electrode of the liquid crystal panel 102 and, via the capacitance line, to the auxiliary capacitance electrodes. The power circuit 106 applies a plurality of voltages (to be discussed below) to the gate and source drivers 103 and 104. The control circuit 105 supplies various signals, such as a clock signal CK and a start pulse signal SP, to the gate and source drivers 103 and 104.

The operations of the gate driver 103 are controlled based on the signals supplied by the control circuit 105, such as the clock signal CK and the start pulse signal SP. The plurality of voltages from the power circuit 106 are applied to the gate driver 103, which supplies signals to the plurality of gate signal lines 108.

The operations of the source driver 104 are controlled based on the signals supplied by the control circuit 105. The plurality of voltages from the power circuit 106 are applied to the source driver 104, which supplies signals to the plurality of source signal lines 109. The source driver 104 drives the pixel electrodes of the liquid crystal panel by applying voltages to the source signal lines 109.

As shown in FIG. 16, the gate driver 103 is made up of a control logic 111, a bi-directional shift register 112, a level shifter 113, an output circuit 114, etc. The gate driver 103 is also provided with terminals for accepting input of the clock signal CK, the start pulse signal SP, a voltage VCC (power source voltage), a voltage GND (ground voltage), and a voltage VDD, and is provided with a plurality of output terminals OS1 through OSn.

The control logic 111 generates and supplies to the bi-directional shift register 112 a signal necessary for the operation thereof. The bidirectional shift register 112, upon receipt of the clock signal CK and the start pulse signal SP, performs shift operations to successively synchronize the start pulse signal SP with the clock signal CK. The bi-directional shift register 112 generates and outputs to the level shifter 113 selection pulses for selecting which pixel electrodes of the liquid crystal panel 102 are to be driven by application of voltage to the source signal lines 109 by the source driver 104. The level shifter 113 converts the voltage of each selection pulse to a level required for ON/OFF (selection/non-selection) operation of the TFT elements of the liquid crystal panel 102, and outputs the converted voltages to the output circuit 114.

The output circuit 114, based on the signals received from the level shifter 113, applies voltages of levels necessary for ON/OFF operation of the TFT elements to the gate signal lines 108 via the corresponding output terminals OS1 through OSn. In other words, as shown in FIG. 17, when an input signal of voltage VCC is supplied, the output circuit 114 supplies an output signal of voltage VDD successively to the output terminals OS1 through OSn, but when no input signal is supplied (when voltage is GND), the output circuit 114 supplies an output signal of voltage VSS to the output terminals OS1 through OSn.

In contrast, a liquid crystal display device 121 provided with a liquid crystal panel 122 having a Cs-on-gate structure, shown in FIG. 18, includes a gate driver 123 instead of the gate driver 103. Each auxiliary capacitance electrode of the liquid crystal panel 122 is connected to an adjacent gate signal line 108. In other words, the gate signal lines 108 are also used as capacitance lines, and each electrode receives superimposed signals.

The counter electrode driving circuit 107 supplies the counter electrode signal AC to both the power circuit 106 and the counter electrode of the liquid crystal panel 122. The power circuit 106, based on the counter electrode signal AC supplied from the counter electrode driving circuit 107, generates a rectangular wave signal ACK and supplies it to the gate driver 123.

As shown in FIG. 19, the gate driver 123 further includes an input terminal for receiving input of the rectangular wave signal ACK. The rectangular wave signal ACK is supplied to the output circuit 114. The output circuit 114, based on the signal received from the level shifter 113 and the rectangular wave signal ACK, applies voltages of levels necessary for ON/OFF operation of the TFT elements to the gate signal lines 108 via the corresponding output terminals OS1 through OSn. In other words, as shown in FIG. 20, when an input signal of voltage VCC is supplied, the output circuit 114 supplies an output signal of voltage VDD successively to the output terminals OS1 through OSn, but when no input signal is supplied (when voltage is GND), the output circuit 114 supplies the rectangular wave signal ACK to the output terminals OS1 through OSn.

As explained above, the power circuit and the gate driver for driving the gate signal lines are structured differently in a liquid crystal display device provided with a liquid crystal panel having the Cs-on-common structure and one provided with a liquid crystal panel having the Cs-on-gate structure. In other words, since liquid crystal panels of the Cs-on-common and Cs-on-gate structures use different respective methods to drive the gate signal lines, in the foregoing conventional liquid crystal display devices, it was necessary to use (install in the liquid crystal display device) one of two different types of gate driver and power circuit, depending on the structure of the liquid crystal panel. Accordingly, shortcomings of the conventional art were that the process for manufacturing liquid crystal display devices was complicated, and the liquid crystal display devices manufactured thereby were not versatile.

SUMMARY OF THE INVENTION

It is an object of the present invention to provide a liquid crystal display device able to drive gate signal lines of display means of both the so-called Cs-on-common structure and the so-called Cs-on-gate structure, using a single driving means and a single power source device.

In order to attain the foregoing object, a liquid crystal display device according to the present invention is made up of driving means capable of driving gate signal lines of display means having a first structure, in which auxiliary capacitance electrodes forming auxiliary capacitances with pixel electrodes are connected to capacitance lines, and capable of driving gate signal lines of display means having a second structure, in which the auxiliary capacitance electrodes are connected to the gate signal lines; and a power source device which applies a voltage to the display means through the driving means; in which the driving means include switching means for changing the voltage applied to the display means from the power source device, to enable driving of the gate signal lines in accordance with the first or second structure of the display means.

With the foregoing structure, the driving means for driving the gate signal lines include switching means, which change the voltage applied to the display means from the power source device in accordance with the structure of the display means. In-this way, by providing the driving means with switching means which change the voltage applied from the power source device so as to be compatible with both the Cs-on-common and Cs-on-gate structures, the liquid crystal display device according to the present invention can perform gate signal line driving which is in accordance with the structure of the display means, using a single driving means. Consequently, it is not necessary to provide the liquid crystal display device with two kinds of driving means and switch back and forth between them depending on the structure of the display means. Accordingly, the process for manufacturing the liquid crystal display device can be simplified, and versatility of the liquid crystal display device can be improved.

Further, the liquid crystal display device according to the present invention is preferably structured as above, further provided with voltage generating means for generating a voltage for AC driving of gate signal lines of display means having the second structure, in which the auxiliary capacitance electrodes are connected to the gate signal lines.

In this way, by providing, for example, the power source device or the switching means with voltage generating means for generating a voltage for AC driving of gate signal lines of display means of the Cs-on-gate structure, the liquid crystal display device according to the present invention can apply voltages and perform gate signal line driving which is in accordance with the structure of the display means, using a single driving means. Consequently, it is not necessary to provide the liquid crystal display device with two kinds of driving means and switch back and forth between them depending on the structure of the display means. Accordingly, the process for manufacturing the liquid crystal display device can be simplified, and versatility of the liquid crystal display device can be improved.

Moreover, when the foregoing voltage generating means are provided in the switching means, the power source device, which is a so-called peripheral device (circuit), can be streamlined, thus contributing to miniaturization of the liquid crystal display device in cases when portability of the liquid crystal display device is highly desirable.

Further, the liquid crystal display device according to the present invention is preferably structured as above, further provided with power consumption reducing means for stopping operation of the voltage generating means during stand-by of the liquid crystal display device.

By providing the liquid crystal display device according to the present invention with power consumption reducing means, operation of the voltage generating means can be stopped during stand-by. Accordingly, the power consumed by operation of the voltage generating means can be saved, thus reducing the power consumption of the liquid crystal display device during stand-by.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 4(*b*) is a plan view showing the structure of chief members of the liquid crystal panel shown in FIG. 4(*a*).

FIG. 5(*b*) is a plan view showing the structure of chief members of the liquid crystal panel shown in FIG. 5(*a*).

DESCRIPTION OF THE EMBODIMENTS

The following will explain one embodiment of the present invention with reference to FIGS. 1 through 5(*b*)

[FIRST EMBODIMENT]

Figure 1:
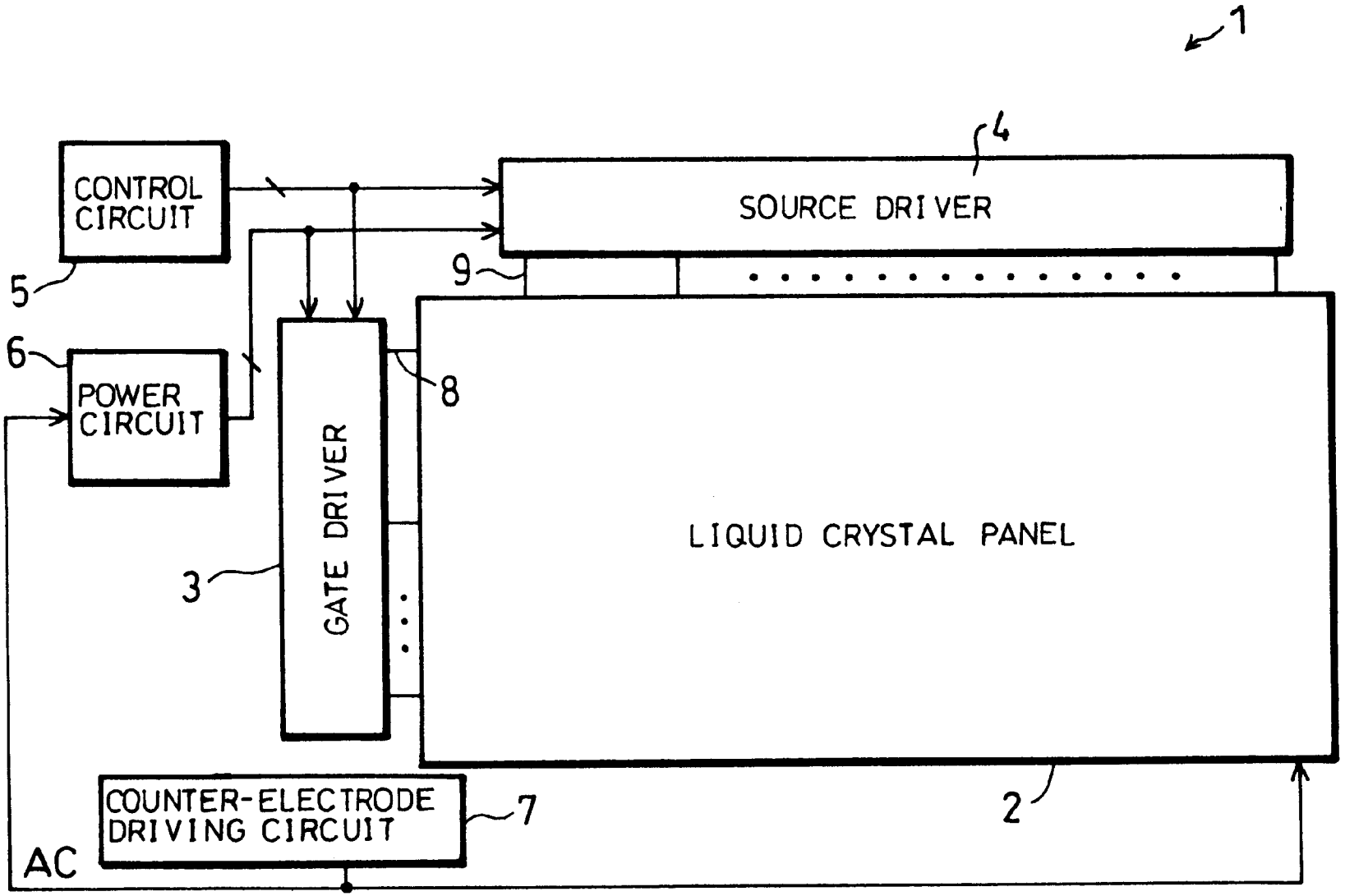
FIG. 1 is a block diagram schematically showing the structure of a liquid crystal display device according to one embodiment of the present invention.

As shown in FIG. 1, a liquid crystal display device 1 according to the present embodiment is an active matrix liquid crystal display device, and includes a liquid crystal panel 2 (display means), a gate driver 3 (driving means), a source driver 4, a control circuit 5, a power circuit 6 (power source device) which is a power source for the liquid crystal driving system, and a counter electrode driving circuit 7 (power source device). The liquid crystal display device according to the present embodiment may be, for example, a liquid crystal television, a projector, a video camera (viewfinder), an automobile navigation system, an amusement device, etc.

Figure 4A:
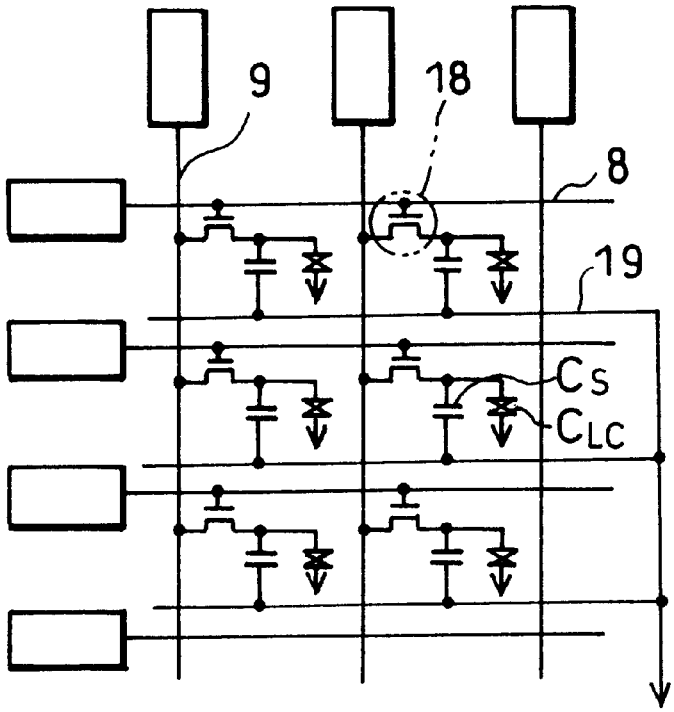
FIG. 4(*a*) is a block diagram schematically showing the circuit structure of a liquid crystal panel having a Cs-on-common structure, provided in the foregoing liquid crystal display device.
Figure 4B:
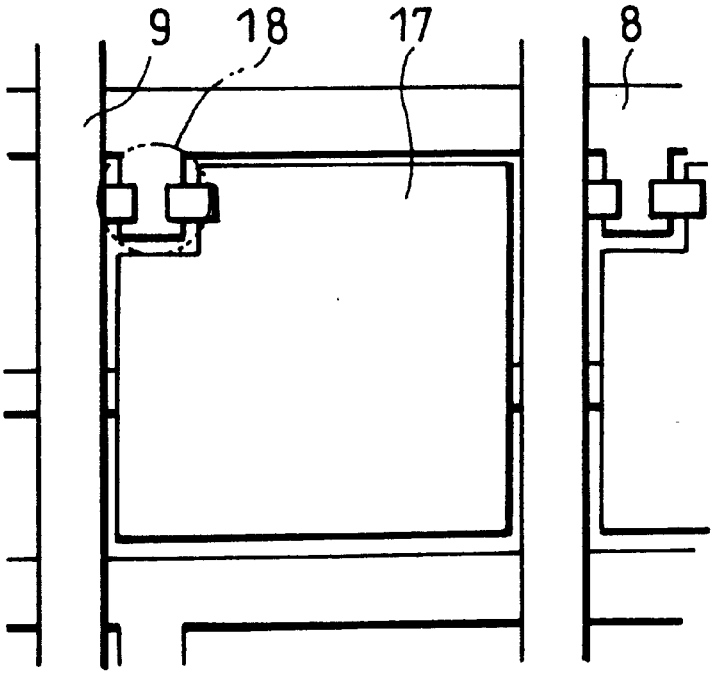
Figure 5:
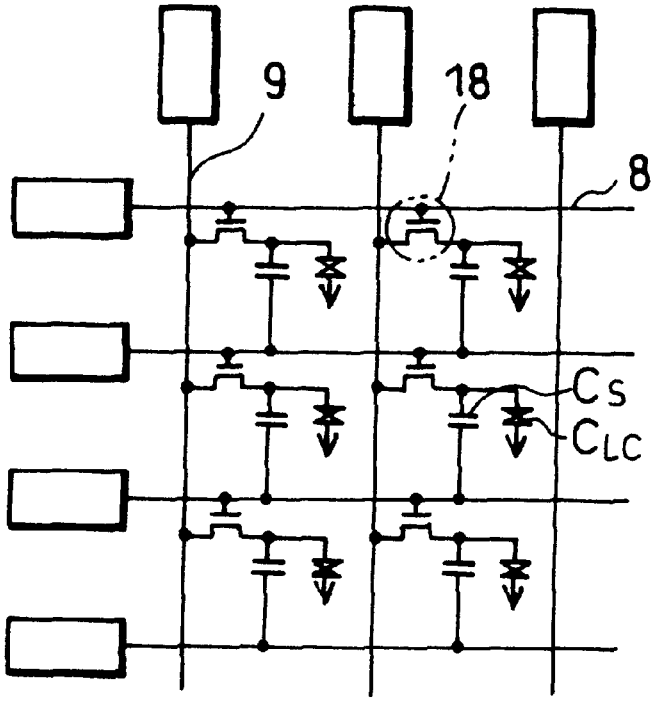
FIG. 5(*a*) is a block diagram schematically showing the circuit structure of a liquid crystal panel having a Cs-on-gate structure, provided in the foregoing liquid crystal display device.
Figure 5B:
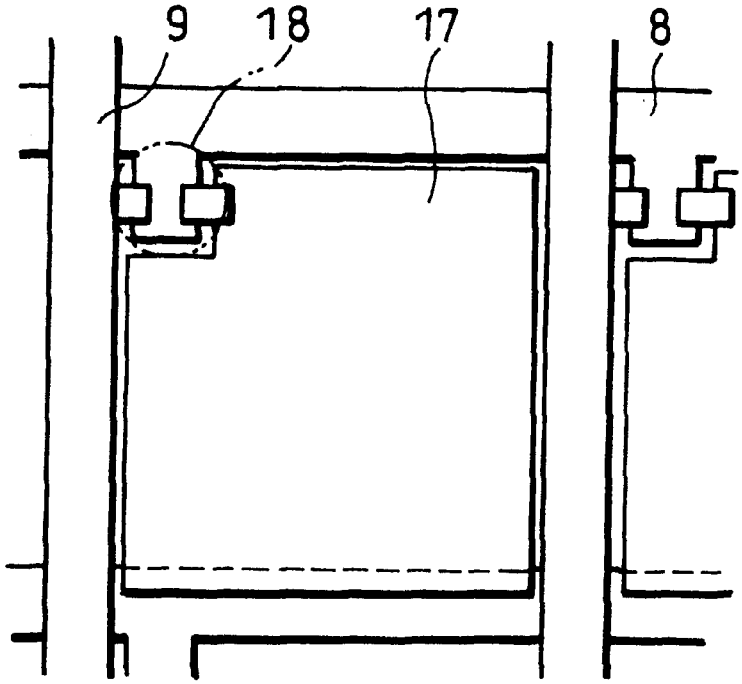

As shown in FIGS. 4(*a*) through 5(*b*), the liquid crystal panel 2 includes a plurality of independently driven pixel electrodes 17, arranged in a matrix on an insulating substrate, and may have a Cs-on-common structure, shown in FIGS. 4(*a*) and 4(*b*), or a Cs-on-gate structure, shown in FIGS. 5(*a*) and 5(*b*). The liquid crystal panel 2 has a plurality of gate signal lines 8 and source signal lines 9, extending in intersecting directions on the insulating substrate, and is driven by the active matrix driving method. In the vicinity of each area where the gate signal lines 8 and the source signal lines 9 cross, the liquid crystal panel 2 is provided with, for example, TFT (thin-film transistor) elements 18 as switching elements for selective driving of the pixel electrodes 17. Each TFT element 18 is connected to a pixel electrode 17. The liquid crystal panel 2 also includes a counter electrode (not shown), provided opposite the pixel electrodes 17, thus forming a liquid crystal capacitance $C_{LC}$. Further, the liquid crystal panel 2 is provided with auxiliary capacitance electrodes (not shown), each of which forms an auxiliary capacitance $C_s$ (holding capacitance) with a pixel electrode 17. The auxiliary capacitance $C_s$ holds a voltage applied to the pixel electrode 17 for a fixed period.

When the liquid crystal panel 2 has a Cs-on-common structure, as shown in FIGS. 4(*a*) and 4(*b*), each auxiliary capacitance electrode is connected to a capacitance line 19. The capacitance lines 19 run parallel to the gate signal lines 8, and are connected to a counter electrode line connected in turn to the counter electrode. All of the capacitance lines 19 are fixed at a common potential. When, on the other hand, the liquid crystal panel 2 has a Cs-on-gate structure, as shown in FIGS. 5(*a*) and 5(*b*), each auxiliary capacitance electrode is connected to the adjacent gate signal line 8. In other words, in the Cs-on-gate structure, the gate signal lines 8 are also used as capacitance lines, and supply superimposed signals to each electrode. In this way, auxiliary capacitance electrodes forming auxiliary capacitances $C_s$ with the pixel electrodes 17 are connected to capacitance lines 19 in a liquid crystal panel with a Cs-on-common structure, and to gate signal lines 8 in a liquid crystal panel with a Cs-on-gate structure. Incidentally, liquid crystal panels of the Cs-on-gate structure have a higher aperture ratio than those of the Cs-on-common structure.

As shown in FIG. 1, the counter electrode driving circuit 7 supplies a counter electrode signal AC to the power circuit 6 and to the counter electrode of the liquid crystal panel 2. The power circuit 6 supplies a plurality of voltages to the gate driver 3 and the source driver 4. Further, using voltage generating means incorporated therein, the power circuit 6 generates a rectangular wave signal ACK based on the counter electrode voltage AC supplied by the counter electrode driving circuit 7, and supplies the signal ACK to the gate driver 3. The control circuit 5 supplies various signals, such as a clock signal CK and a start pulse signal SP, to the gate driver 3 and the source driver 4.

Operation of the gate driver 3 is controlled on the basis of the signals supplied by the control circuit 5. The power circuit 6 applies a plurality of different voltages (to be discussed below) to the gate driver 3, and the gate driver 3 supplies signals to the gate signal lines 8.

Operation of the source driver 4 is controlled on the basis of the signals supplied by the control circuit 5. The power circuit 6 applies a plurality of different voltages (to be discussed below) to the source driver 4, and the source driver 4 supplies signals to the source signal lines 9. By applying voltages to the source signal lines 9, the source driver 4 drives the pixel electrodes 17 of the liquid crystal panel 2.

Figure 2:
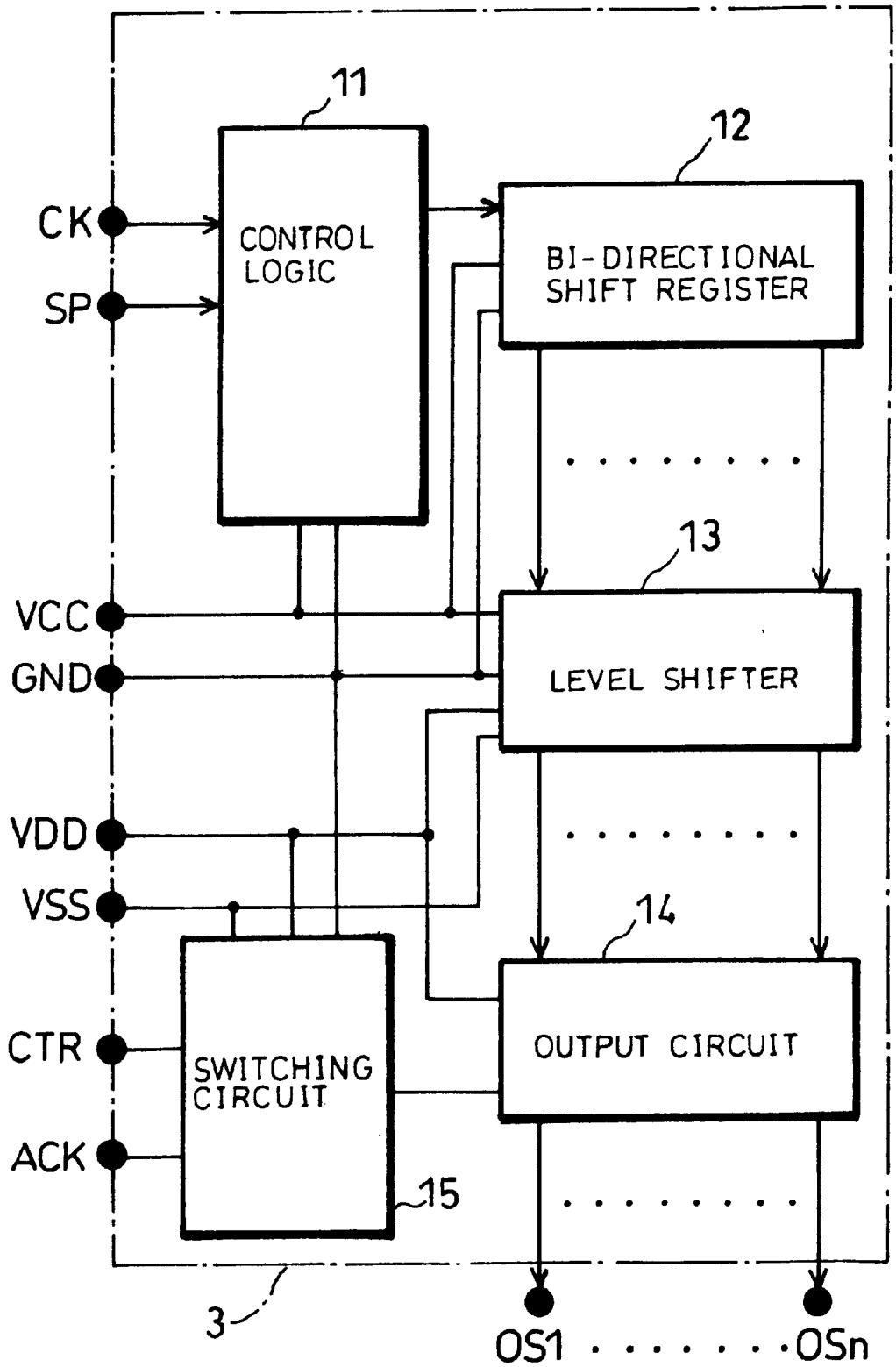
FIG. 2 is a block diagram schematically showing the circuit structure of a gate driver provided in the foregoing liquid crystal display device.

As shown in FIG. 2, the gate driver 3 is made up of a control logic 11, a bi-directional shift register 12, a level shifter 13, an output circuit 14, a switching circuit 15 (switching means), etc. The gate driver 3 is also provided with terminals for accepting input of the clock signal CK, the start pulse signal SP, a voltage VCC (power source voltage), a voltage GND (ground voltage), a voltage VDD (High), a voltage VSS (Low), and the rectangular wave signal ACK, and with a setting terminal CTR and a plurality of output terminals OS1 through OSn arranged as lines.

To the control logic 11 are applied the voltage VCC (power source voltage) and the voltage GND (ground voltage) from the power circuit 6, and the clock signal CK and the start pulse signal SP from the control circuit 5. The control logic 11 generates and supplies to the bi-directional shift register 112 a signal necessary for the operation thereof.

To the bi-directional shift register 12 are applied the voltage VCC, the voltage GND, etc. from the power circuit 6, and the foregoing signal from the control logic 11. Upon receipt of the clock signal CK and the start pulse signal SP from the control circuit 5 via the control logic 11, the bi-directional shift register 12 performs shift operations to successively synchronize the start pulse signal SP with the clock signal CK. The bi-directional shift register 12 generates and outputs to the level shifter 13 selection pulses for selecting which pixel electrodes 17 of the liquid crystal panel 2 are to be driven by application of voltages to the source signal lines 9 by the source driver 4. Incidentally, the bi-directional shift register 12 can switch the order (direction) of liquid crystal driving outputs.

To the level shifter 13 are applied the voltages VCC, GND, VDD (High), and VSS (Low) from the power circuit 6, and the foregoing selection pulses from the bi-directional shift register 12. The level shifter 13 converts the voltage of each selection pulse to bring the level thereof to a level required for ON/OFF operation (selection/non-selection) of the e.g. TFT elements 18 of the liquid crystal panel 2, and outputs the converted voltages to the output circuit 14. Here, the voltages VCC, GND, VDD, and VSS are set to, for example, 5V, 0V, 13V, and −15V.

The output circuit 14 receives the voltage VDD from the power circuit 6 and the selection pulses from the level shifter 13, and receives from the switching circuit 15 the voltage VDD and either the voltage VSS or the rectangular wave signal ACK. The output circuit 14 is provided with a plurality of output terminals OS1 through OSn, for supplying signals to the gate signal lines 8. The output terminals and gate signal lines 8 have a one-to-one correspondence (connection) with each other. Based on signals from the level shifter 13 and the switching circuit 15, the output circuit 14 amplifies the signals from the level shifter 13 in an output buffer to obtain voltages of a level required for ON/OFF operation (selection/non-selection) of the e.g. TFT elements 18, and applies these voltages to the gate signal lines 8 via the corresponding output terminals OS1 through OSn.

To the switching circuit 15 are applied the voltages GND, VDD, VSS, etc. from the power circuit 6, and the rectangular wave signal ACK generated by the power circuit 6. The switching circuit 15 is provided with a setting terminal CTR for selecting, in addition to the voltage VDD, whether to input the voltage VSS or the rectangular wave signal ACK to the output circuit 14. Based on a voltage applied to the setting terminal CTR, the switching circuit 15 switches the voltage to be applied by the power circuit 6 to the gate signal lines 8 through the output circuit 14. To the setting terminal CTR is applied either the voltage VDD or the voltage VSS.

Figure 3:
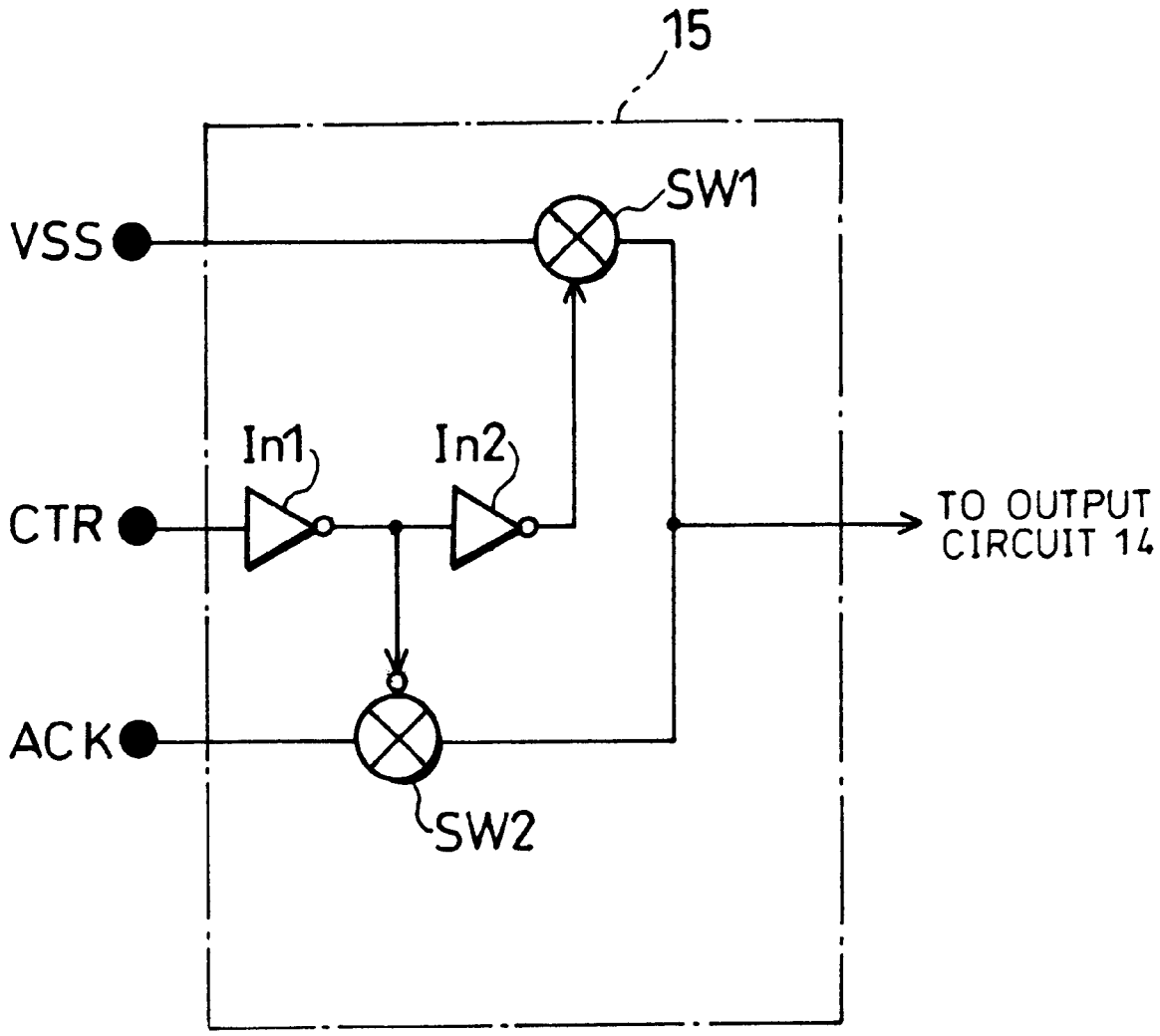
FIG. 3 is a circuit diagram of a switching circuit provided in the foregoing gate driver.

As shown in FIG. 3, the switching circuit 15 is made up of analog switches SW1 and SW2 (analog gates), inverters In1 and In2, etc. The analog switches SW1 and SW2 are, for example, transmission gates made up of a p-channel MOS (metal-oxide-semiconductor) and an n-channel MOS. The voltage VSS is applied to the analog switch SW1, which is connected to the output circuit 14, and, via the inverters In1 and In2, to the setting terminal CTR. The rectangular wave signal ACK is applied to the analog switch SW2, which is connected to the output circuit 14 and, via the inverter In1, to the setting terminal CTR.

In the foregoing structure, when a voltage of VDD is applied to the setting terminal CTR, due to action of the inverters In1 and In2, the analog switch SW1 receiving the voltage VSS is selected (the switch is closed). As a result, the switching circuit 15 outputs to the output circuit 14 voltages of levels corresponding to ON/OFF of the TFTs 18. In other words, the switching circuit 15 outputs to the output circuit 14 a voltage of VDD for ON (selection), and a voltage of VSS for OFF (non-selection) of the TFTs 18. Based on these received voltages, the output circuit 14 applies a voltage of a level necessary for ON/OFF operation of each TFT 18 to the corresponding output terminal OS1 through OSn. Consequently, the gate driver is compatible with the Cs-on-common structure.

When, on the other hand, a voltage of VSS is applied to the setting terminal CTR, due to action of the inverters In1 and In2, the analog switch SW2 receiving the rectangular wave signal ACK is selected. As a result, the switching circuit 15 outputs to the output circuit 14 voltages of levels corresponding to ON/OFF of the TFTs 18. In other words, the switching circuit 15 outputs to the output circuit 14 a voltage of VDD for ON (selection), and a voltage (AC voltage) of the rectangular wave signal ACK for OFF (non-selection) of the TFTs 18. Based on these received voltages, the output circuit 14 applies a voltage of a level necessary for ON/OFF operation of each TFT 18 to the corresponding output terminal OS1 through OSn. Consequently, the gate driver is compatible with the Cs-on-gate structure.

In other words, in a liquid crystal panel 2 having a Cs-on-gate structure, when the potential of the counter electrode is constant, a voltage (Vlc) held by the liquid crystal capacitance $C_{LC}$ during a holding period when the pixel electrode 17 is not driven is also constant. However, when, for example, the counter electrode is AC driven, the AC voltage causes spikes in the voltage (Vlc), which thus fluctuates, and as a result the potential of the liquid crystal layer also fluctuates. Accordingly, in order to cancel out this fluctuation in potential, the rectangular wave signal ACK is applied to the auxiliary capacitance $C_s$ via the gate signal line 8, thus AC driving the auxiliary capacitance $C_s$ with the same phase and amplitude as the AC driving of the counter electrode. With this structure, the switching circuit 15 outputs to the output circuit 14 a voltage of VDD for ON (selection) of the TFTs 18, and a voltage of the rectangular wave signal ACK, generated based on the counter electrode signal AC, for OFF (non-selection) of the TFTs 18, and the output circuit 14 applies a voltage of a level necessary for ON/OFF operation of each TFT 18 to the corresponding output terminal OS1 through OSn. Accordingly, the gate driver 3 is compatible with the Cs-on-gate structure.

In a liquid crystal display device 1 with the foregoing structure, the gate driver 3 is provided with a switching circuit 15 which changes the voltage applied to the liquid crystal panel 2 depending on the structure of the liquid crystal panel 2. Further, in the liquid crystal display device 1, the power circuit 6 has voltage generating means incorporated therein. In other words, since the gate driver 3 is provided with a switching circuit 15 which changes the voltage applied from the power circuit 6 so as to be compatible with both Cs-on-common and Cs-on-gate structures, a liquid crystal display device 1 with the foregoing structure can, using a single gate driver 3 and a single power circuit 6, drive the gate signal lines 8 using driving corresponding to the structure of the liquid crystal panel 2. Consequently, it is not necessary to provide the liquid crystal display device with two kinds of gate drivers and power sources and switch back and forth between them depending on the structure of the liquid crystal panel. Accordingly, the process for manufacturing the liquid crystal display device can be simplified, and versatility of the liquid crystal display device can be improved.

Incidentally, the circuit structure of the switching circuit 15 is not limited to that discussed above; any equivalent circuit structure may be used. Further, the present embodiment explained an example of a liquid crystal display device 1 provided with a liquid crystal panel 2 which uses TFT elements 18, but the switching elements for selectively driving the pixel electrodes 17 are not limited to TFT elements. Alternatively, MIM (metal-insulator-metal) elements, MOS transistors, diodes, varistors, etc. may be used. In any of these cases, it is sufficient to change part of the structure of the gate driver 3 according to the switching element used.

[SECOND EMBODIMENT]

The following will explain another embodiment of the present invention with reference to FIGS. 6 through 10. For ease of explanation, members (structures) having the same functions as those shown in the drawings pertaining to the first embodiment above will be given the same reference symbols, and explanation thereof will be omitted here.

Figure 6:
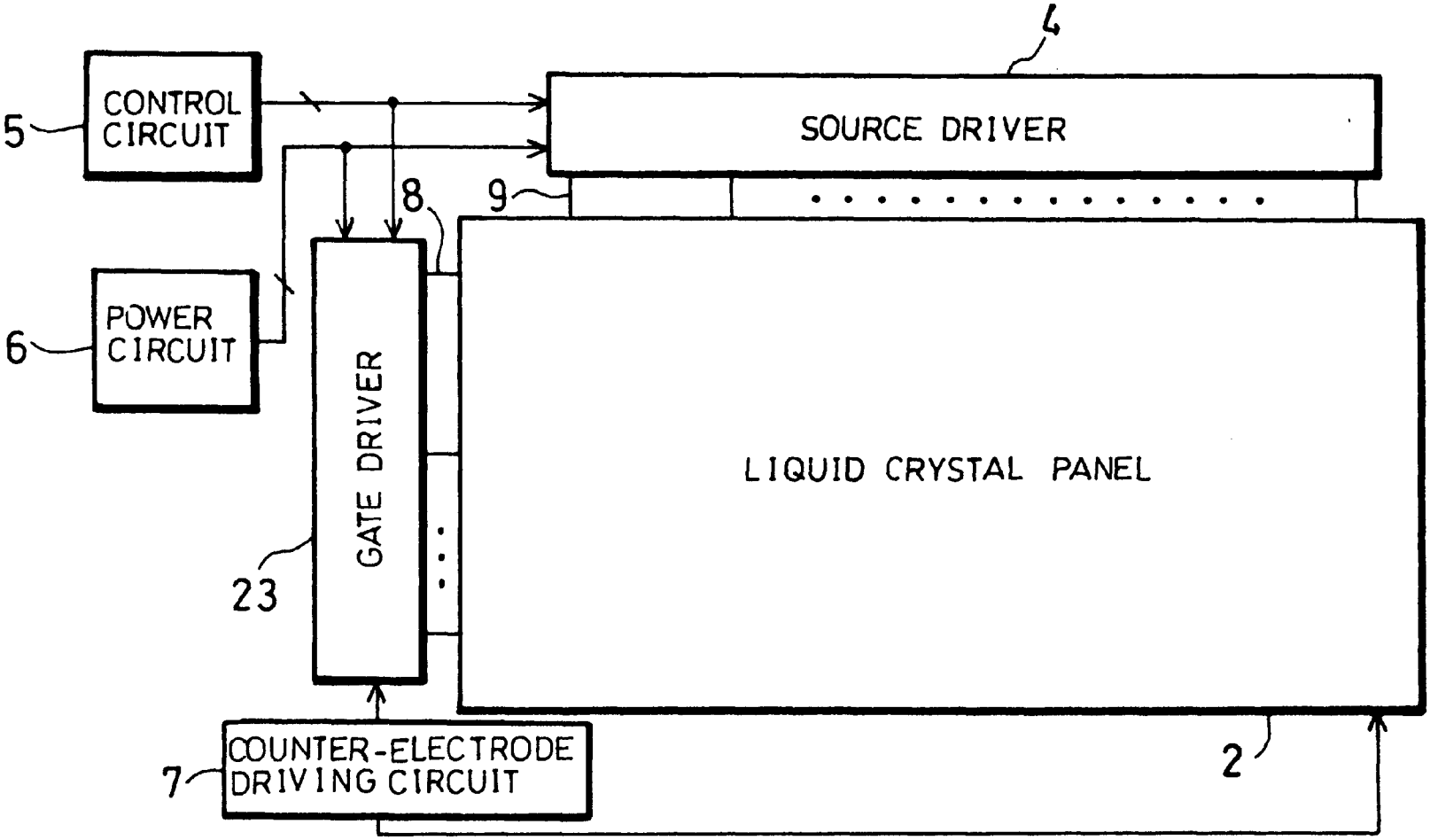
FIG. 6 is a block diagram schematically showing the structure of a liquid crystal display device according to another embodiment of the present invention.

As shown in FIG. 6, a liquid crystal display device 21 according to the present embodiment is provided with a gate driver 23 (driving means) instead of the gate driver 3 (FIG. 1). The counter electrode driving circuit 7 supplies a counter electrode signal AC to the gate driver 23 and to the counter electrode of the liquid crystal panel 2. The power circuit 6 applies a plurality of voltages to the gate driver 23 and the source driver 4.

Operation of the gate driver 23 is controlled on the basis of various signals supplied by the control circuit 5, such as a clock signal CK and a start pulse signal SP. The gate driver 23 receives a plurality of different voltages from the power circuit 6, and receives the counter electrode signal AC from the counter electrode driving circuit 7. The gate driver 23 supplies signals to the plurality of gate signal lines 8.

The gate driver 23 produces a rectangular wave signal ACK on the basis of the counter electrode signal AC supplied by the counter electrode driving circuit 7. In devices for which portability is considered important, there is generally a strong demand for simplification of peripheral circuits in order to contribute to miniaturization of the device. In the liquid crystal display device 21 according to the present embodiment, in order to respond to the foregoing demand, a voltage generating circuit (voltage generating means) for producing the rectangular wave signal ACK is provided in the gate driver 23, rather than in the power circuit 6. In other words, in the liquid crystal display device 21, the voltage generating circuit which makes up part of the power circuit 6 in the first embodiment above is provided in the gate driver 23, thus allowing simplification of peripheral circuits.

Figure 7:
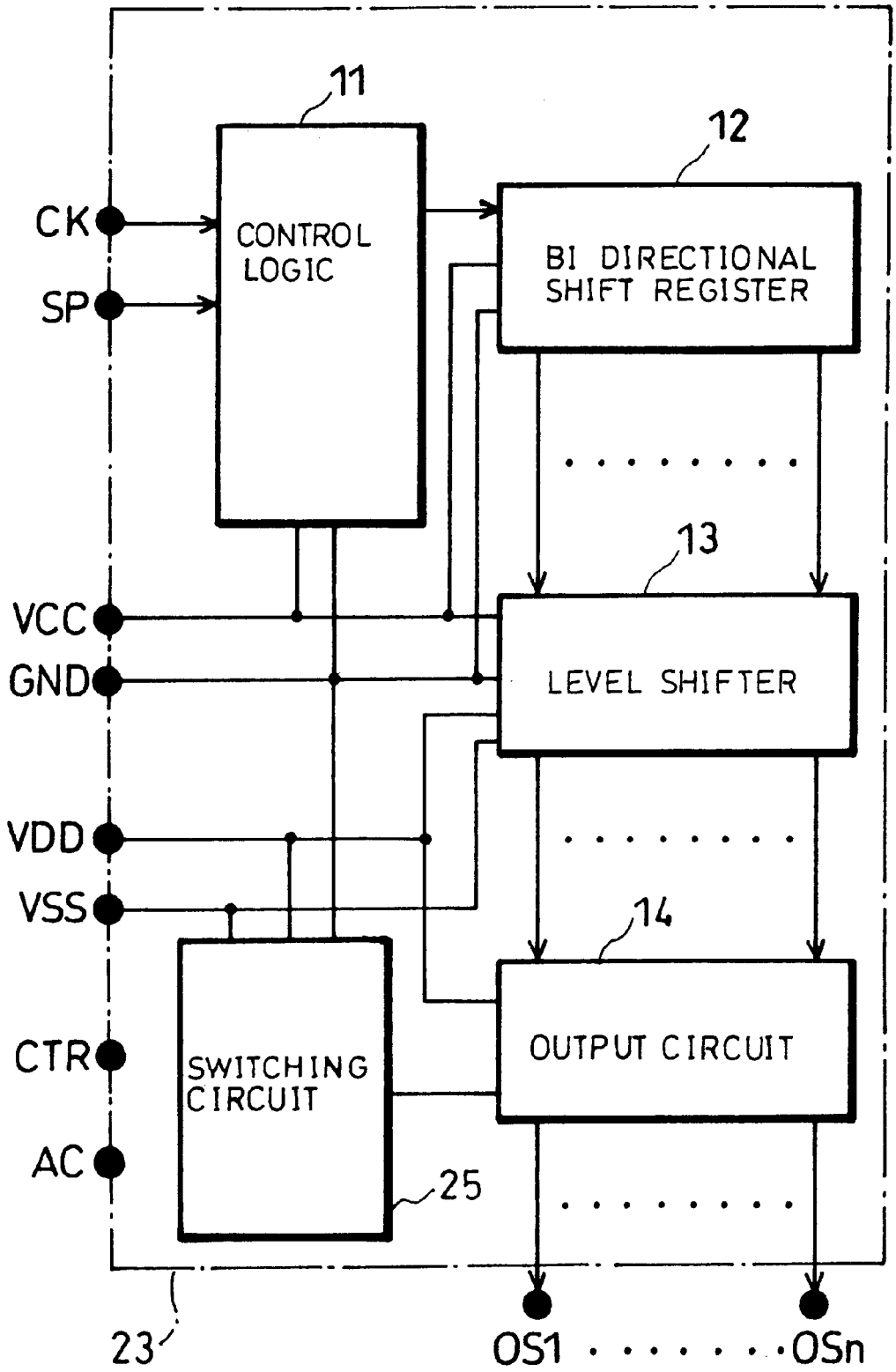
FIG. 7 is a block diagram schematically showing the circuit structure of a gate driver provided in the liquid crystal display device shown in FIG. 6.

As shown in FIG. 7, the gate driver 23 is provided with a switching circuit 25 (switching means) in place of the switching circuit 15 (FIG. 2). The gate driver 23 is also provided with a terminal for accepting input of the counter electrode signal AC (hereinafter referred to as "terminal AC"), instead of the terminal for input of the rectangular wave signal ACK (FIG. 2).

To the switching circuit 25 are applied the voltages GND, VDD, VSS, etc. from the power circuit 6, and the counter electrode signal AC from the counter electrode driving circuit 7. The switching circuit 25 produces the rectangular wave signal ACK from the counter electrode signal AC. Further, the switching circuit 25 is provided with a setting terminal CTR for selecting, in addition to the voltage VDD, whether to input the voltage VSS or the rectangular wave signal ACK to the output circuit 14. Based on a voltage applied to the setting terminal CTR, the switching circuit 25 switches the voltage to be applied by the power circuit 6 to the gate signal lines 8 through the output circuit 14. To the setting terminal CTR is applied either the voltage VDD or the voltage VSS.

Figure 8:
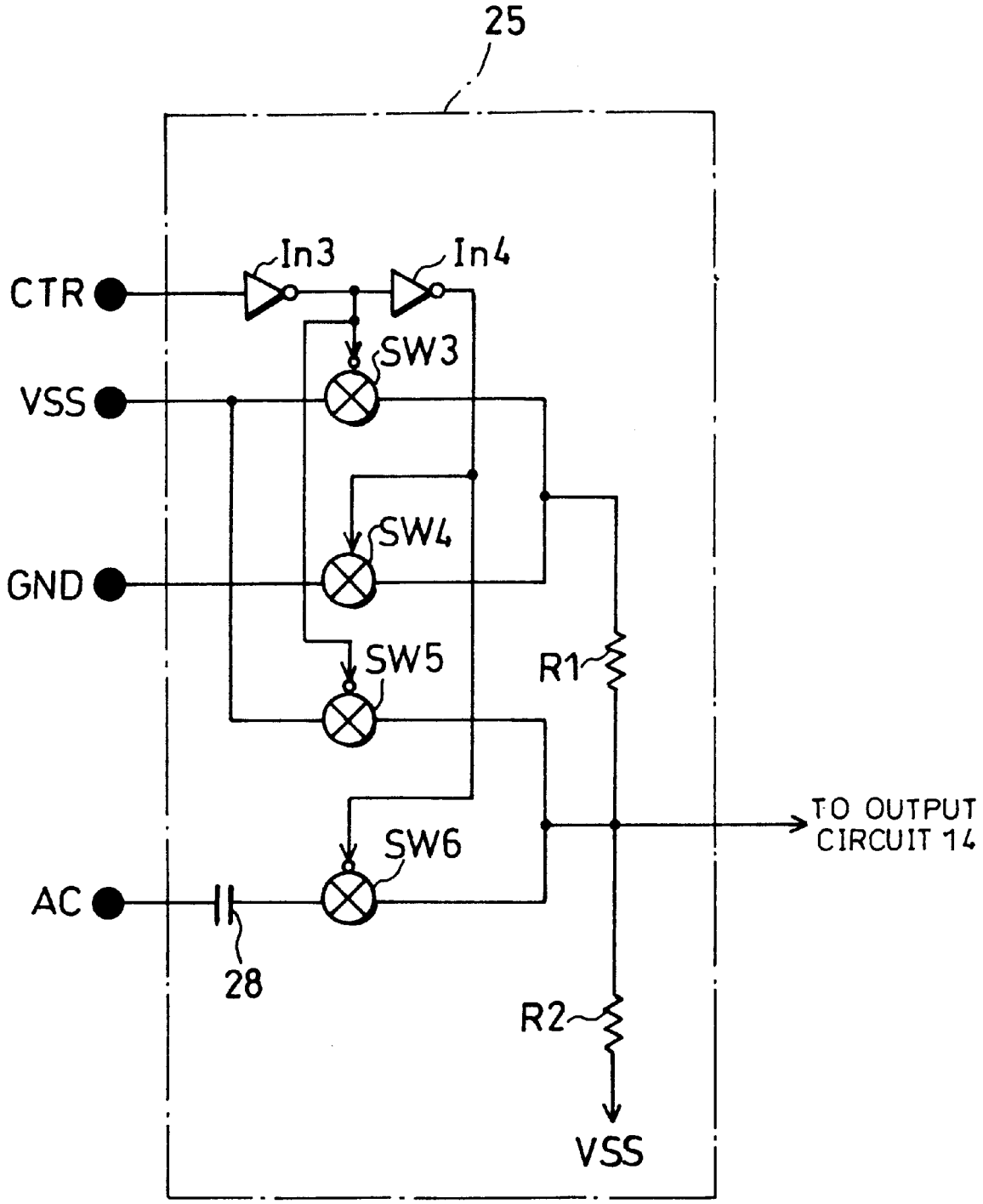
FIG. 8 is a circuit diagram of a switching circuit provided in the gate driver shown in FIG. 7.
Figure 9:
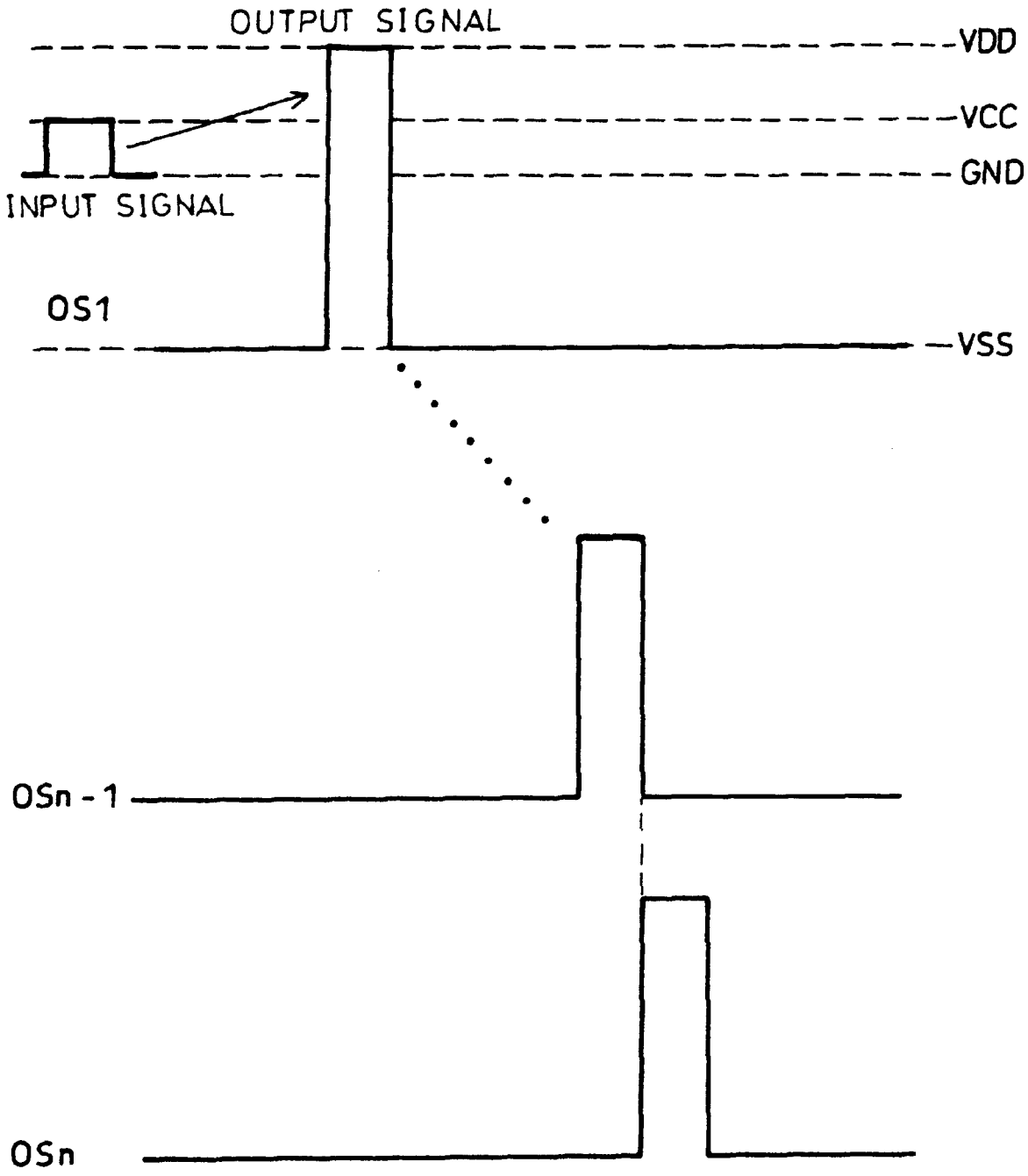
FIG. 9 is a timing chart explaining operation of the gate driver shown in FIG. 7.
Figure 10:
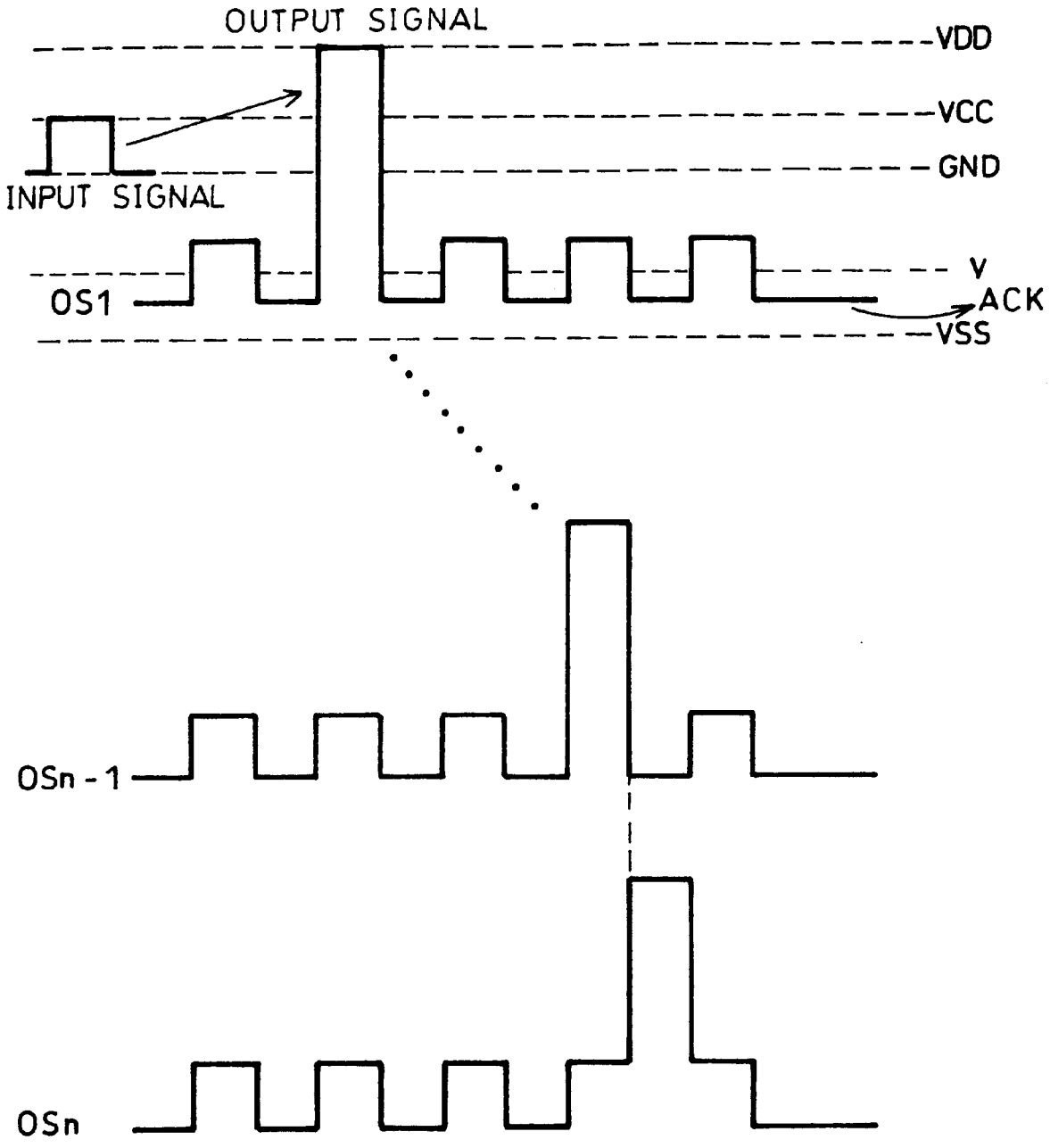
FIG. 10 is a timing chart explaining operation of the gate driver shown in FIG. 7.

As shown in FIG. 8, the switching circuit 25 is made up of a capacitor 28, analog switches SW3 through SW6 (analog gates), inverters In3 and In4, resistor elements R1 and R2, etc. The capacitor 28 (voltage generating means), provided between the counter electrode driving circuit 7 and the analog switch SW6, performs voltage conversion. The analog switches SW3 through SW6 are, for example, transmission gates made up of a p-channel MOS and an n-channel MOS. The voltage VSS is applied to the analog switches SW3 and SW5. The analog switch SW3 is connected to the output circuit 14 via the resistor element R1, and to the setting terminal CTR via the inverter In3. The analog switch SW5 is connected to the output circuit 14, and to the setting terminal CTR via the inverter In3. The voltage GND is applied to the analog switch SW4, which is connected to the output circuit 14 via the resistor element R1, and to the setting terminal CTR via the inverters In3 and In4. A voltage of a level corresponding to the counter electrode signal AC is applied to the analog switch SW6 via the capacitor 28. The analog switch SW6 is connected to the output circuit 14 and to the setting terminal CTR via the inverters In3 and In4. Outputs from the analog switches SW3 through SW6 are voltage divided by the resistor elements R1 and R2 (voltage generating means) and outputted to the output circuit 14.

The remainder of the structural members (structure) of the liquid crystal display device 21 are equivalent to those of the liquid crystal display device 1 according to the first embodiment above.

In the foregoing structure, when a voltage of VSS is applied to the setting terminal CTR, due to action of the inverters In3 and In4, the analog switches SW3 and SW5 receiving the voltage VSS are selected. As a result, the switching circuit 25 outputs to the output circuit 14, via the resistor elements R1 and R2, voltages of levels corresponding to ON/OFF of the TFTs 18. In other words, the switching circuit 25 outputs to the output circuit 14 a voltage of VDD for ON (selection), and a voltage of VSS for OFF (non-selection) of the TFTs 18. Based on these received voltages, the output circuit 14 applies a voltage of a level necessary for ON/OFF operation of each TFT 18 to the corresponding output terminal OS1 through OSn. As shown, for example, in FIG. 9, when an input signal of voltage VCC is supplied, the output circuit 14 supplies output signals of voltage VDD successively to the output terminals OS1 through OSn, but when no input signal is supplied (when voltage is GND), the output circuit 14 supplies output signals of voltage VSS to the output terminals OS1 through OSn. Consequently, the gate driver 23 is compatible with a liquid crystal panel 2 of the Cs-on-common structure.

When, on the other hand, a voltage of VDD is applied to the setting terminal CTR, due to action of the inverters In3 and In4, the analog switch SW4 receiving the voltage GND, and the analog switch SW6 receiving a voltage corresponding to the counter electrode signal AC via the capacitor 28, are selected. As a result, the switching circuit 25 outputs to the output circuit 14 voltages of levels corresponding to ON/OFF of the TFTs 18. In other words, the switching circuit 25 generates the rectangular wave signal ACK, which is a converted voltage centered on a voltage divided between the voltage GND and the voltage VSS by the resistor elements R1 and R2, and outputs to the output circuit 14 a voltage of VDD for ON (selection), and a voltage (AC voltage) of the rectangular wave signal ACK for OFF (non-selection) of the TFTs 18. Based on these received voltages, the output circuit 14 applies a voltage of a level necessary for ON/OFF operation of each TFT 18 to the corresponding output terminal OS1 through OSn. As shown, for example, in FIG. 10, when an input signal of voltage VCC is supplied, the output circuit 14 supplies an output signal of voltage VDD successively to the output terminals OS1 through OSn, but when no input signal is supplied (when voltage is GND), the output circuit 14 supplies the rectangular wave signal ACK centered on a voltage V divided by the resistor elements R1 and R2. Consequently, the gate driver 23 is compatible with a liquid crystal panel of the Cs-on-gate structure.

A liquid crystal display device 21 with the foregoing structure can, using a single gate driver 23, drive the gate signal lines 8 using driving corresponding to the structure of the liquid crystal panel 2. Consequently, it is not necessary to provide the liquid crystal display device with two kinds of gate drivers and power sources and switch back and forth between them depending on the structure of the liquid crystal panel. Accordingly, the process for manufacturing the liquid crystal display device can be simplified, and versatility of the liquid crystal display device can be improved. Further, in the foregoing liquid crystal display device 21, the switching circuit 25 of the gate driver 23 is provided with voltage generating means. Accordingly, it is possible to simplify the power circuit, which is a so-called peripheral device (circuit), thus contributing to miniaturization of the liquid crystal display device in cases when portability is highly desirable.

Incidentally, the circuit structure of the switching circuit 25 is not limited to that discussed above; any equivalent circuit structure may be used. Further, the present embodiment explained an example in which a voltage generating circuit (the capacitor 28 and the resistor elements R1 and R2), for producing the rectangular wave signal ACK for compatibility with a Cs-on-gate structure, is incorporated in the switching circuit 25, but it is sufficient if the voltage generating circuit is provided within the gate driver 23. For example, instead of providing the capacitor 28 in the switching circuit 25, it may be provided between the counter electrode driving circuit 7 and the switching circuit 25.

[THIRD EMBODIMENT]

Figure 11:
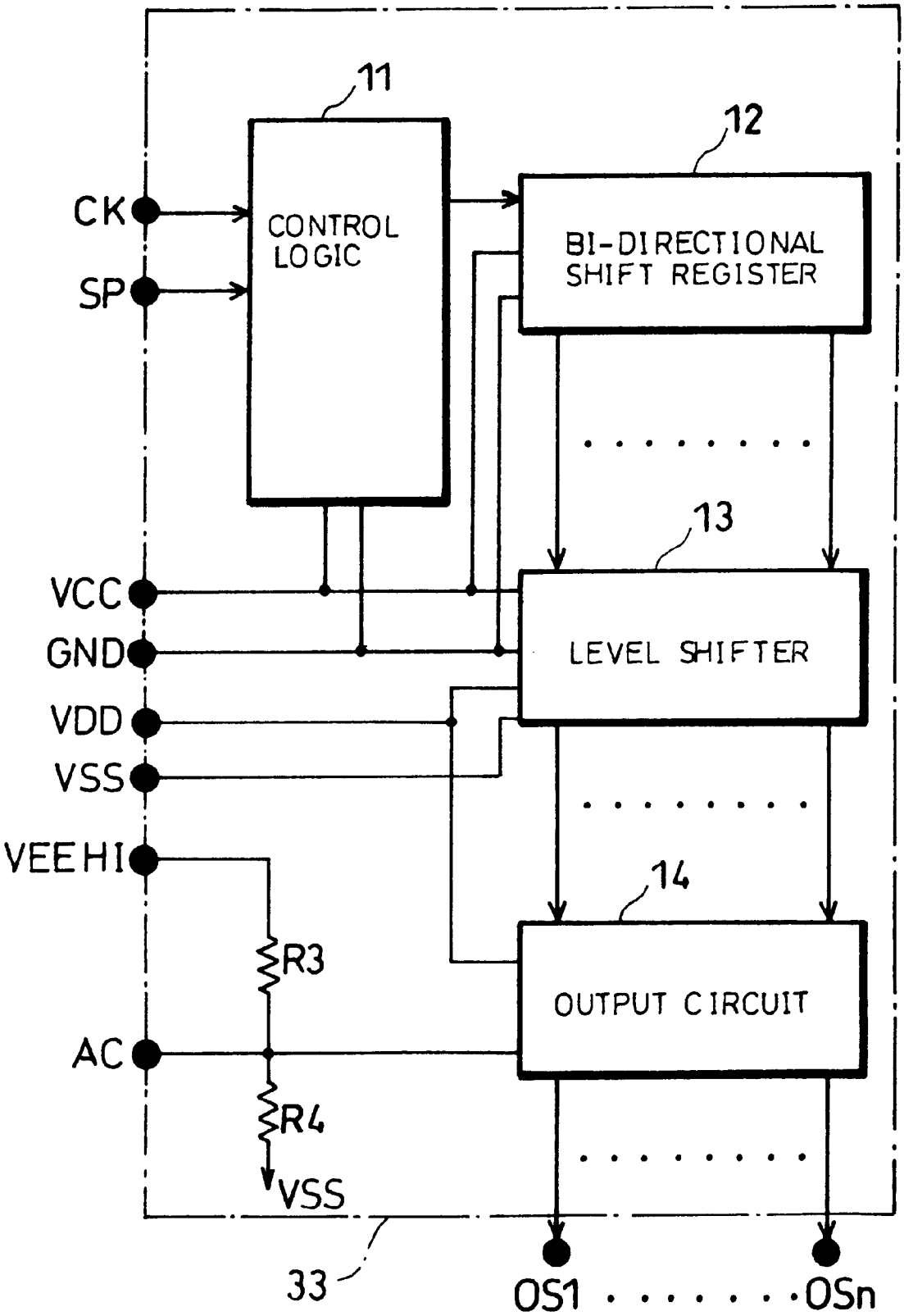
FIG. 11 is a block diagram schematically showing the circuit structure of a gate driver provided in a liquid crystal display device according to a further embodiment of the present invention.

The following will explain a further embodiment of the present invention with reference to FIG. 11. For ease of explanation, members (structures) having the same functions as those shown in the drawings pertaining to the first or second embodiment above will be given the same reference symbols, and explanation thereof will be omitted here.

A liquid crystal display device according to the present embodiment is provided with a gate driver 33 (driving means), shown in FIG. 11, instead of the gate driver 23 (FIG. 7). Operation of the gate driver 33 is controlled on the basis of various signals supplied by the control circuit 5, such as a clock signal CK and a start pulse signal SP. The gate driver 33 receives a plurality of different voltages from the power circuit 6, and receives the counter electrode signal AC from the counter electrode driving circuit 7. The gate driver 33 supplies signals to the plurality of gate signal lines 8. Based on a voltage applied to a setting terminal VEEHI, the gate driver 33 switches a voltage to be applied by the power circuit 6 to the gate signal lines 8 through the output circuit 14.

The gate driver 33 produces a rectangular wave signal ACK on the basis of the counter electrode signal AC supplied by the counter electrode driving circuit 7. Consequently, in the liquid crystal display device according to the present embodiment, as in the liquid crystal display device 21 above, peripheral circuits can be simplified.

As shown in FIG. 11, the gate driver 33 is provided with resistor elements R3 and R4 (switching means; voltage generating means) instead of the switching circuit 25 (FIG. 7). The gate driver 23 is also provided with a setting terminal VEEHI instead of the setting terminal CTR. The setting terminal VEEHI is a terminal for selecting, in addition to the voltage VDD, whether to input the voltage VSS or the rectangular wave signal ACK to the output circuit 14. Further, the setting terminal VEEHI receives either the voltage GND or the voltage VSS. Further, the terminal AC receives either a voltage of a level corresponding to the counter electrode signal AC or the voltage VSS. The resistor elements R3 and R4 are connected to the terminal AC and the setting terminal VEEHI, and to the output circuit 14, and perform voltage division. Here, the capacitor 28 is provided between the counter electrode driving circuit 7 and the terminal AC.

The remainder of the structural members (structure) of the liquid crystal display device according to the present embodiment are equivalent to those of the liquid crystal display device 21 according to the second embodiment above.

In the foregoing structure, when the voltage GND is applied to the setting terminal VEEHI and a voltage of a level corresponding to the counter electrode signal AC is applied to the terminal AC, voltages of levels corresponding to ON/OFF of the TFTs 18 are outputted to the output circuit 14 via the resistor elements R3 and R4. Consequently, the gate driver 33 is compatible with a liquid crystal panel 2 having a Cs-on-common structure.

When, on the other hand, a voltage of VSS is applied to the setting terminal VEEHI and the terminal AC, voltages of levels corresponding to ON/OFF of the TFTs 18 are outputted to the output circuit 14 via the resistor elements R3 and R4. The resistor elements generate the rectangular wave signal ACK, which is a converted voltage centered on a voltage divided between the voltage GND and the voltage VSS by voltage division. Accordingly, a voltage of VDD for ON (selection), and a voltage of the rectangular wave signal ACK for OFF (non-selection) of the TFTs 18 are applied to the output circuit 14. Based on these received voltages, the output circuit 14 applies a voltage of a level necessary for ON/OFF operation of each TFT 18 to the corresponding output terminal OS1 through OSn. Consequently, the gate driver 33 is compatible with a liquid crystal panel having a Cs-on-gate structure.

A liquid crystal display device with the foregoing structure can, using a single gate driver 33, drive the gate signal lines 8 using driving corresponding to the structure of the liquid crystal panel 2. Consequently, it is not necessary to provide the liquid crystal display device with two kinds of gate drivers and power sources and switch back and forth between them depending on the structure of the liquid crystal panel. Accordingly, the process for manufacturing the liquid crystal display device can be simplified, and versatility of the liquid crystal display device can be improved. Further, in the foregoing liquid crystal display device, the gate driver 33 is provided with voltage generating means. Accordingly, it is possible to simplify the power circuit, which is a peripheral device (circuit), thus contributing to miniaturization of the liquid crystal display device in cases when portability is highly desirable.

[FOURTH EMBODIMENT]

Figure 12:
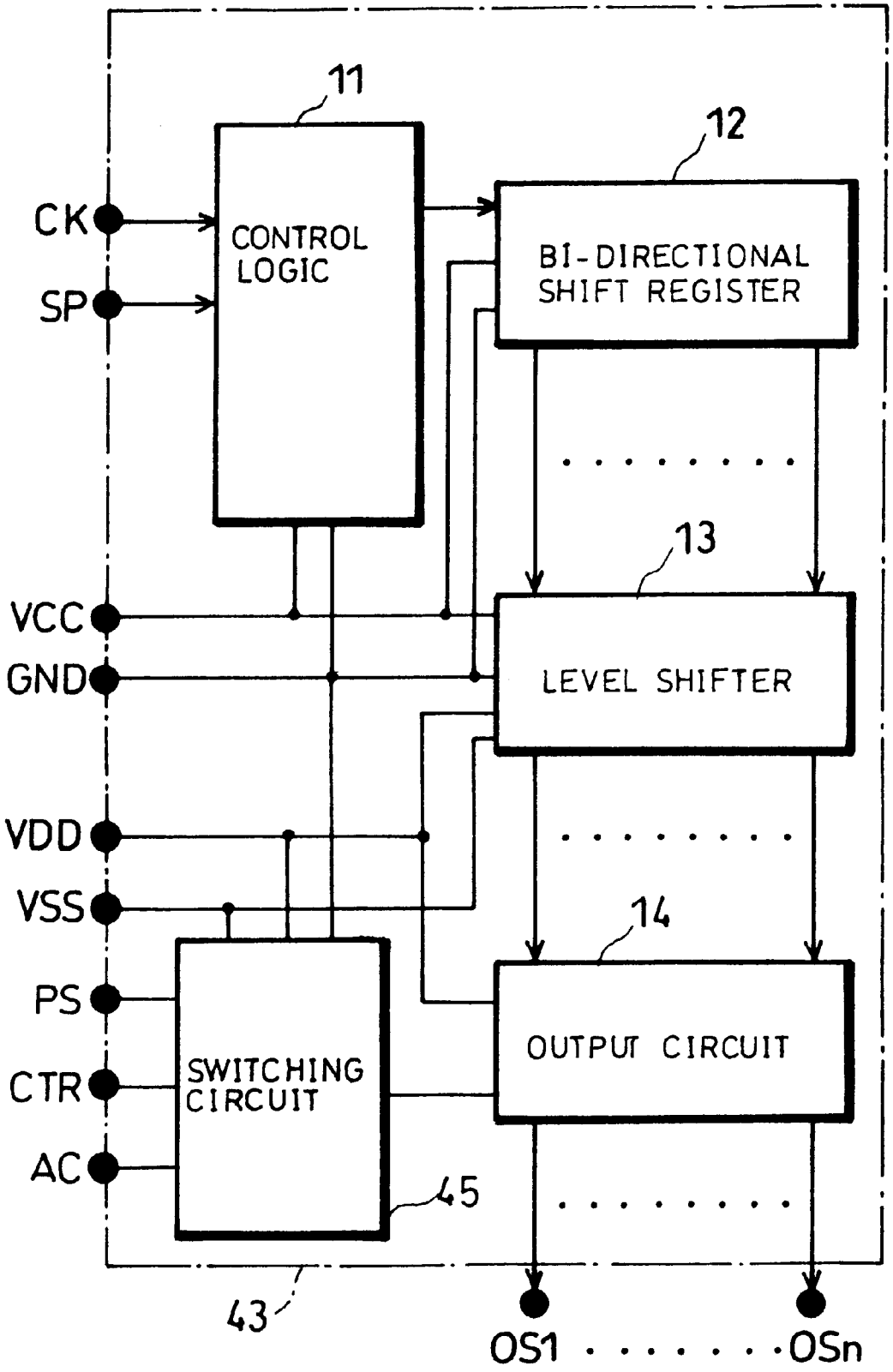
FIG. 12 is a block diagram schematically showing the circuit structure of a gate driver provided in a liquid crystal display device according to a further embodiment of the present invention.
Figure 13:
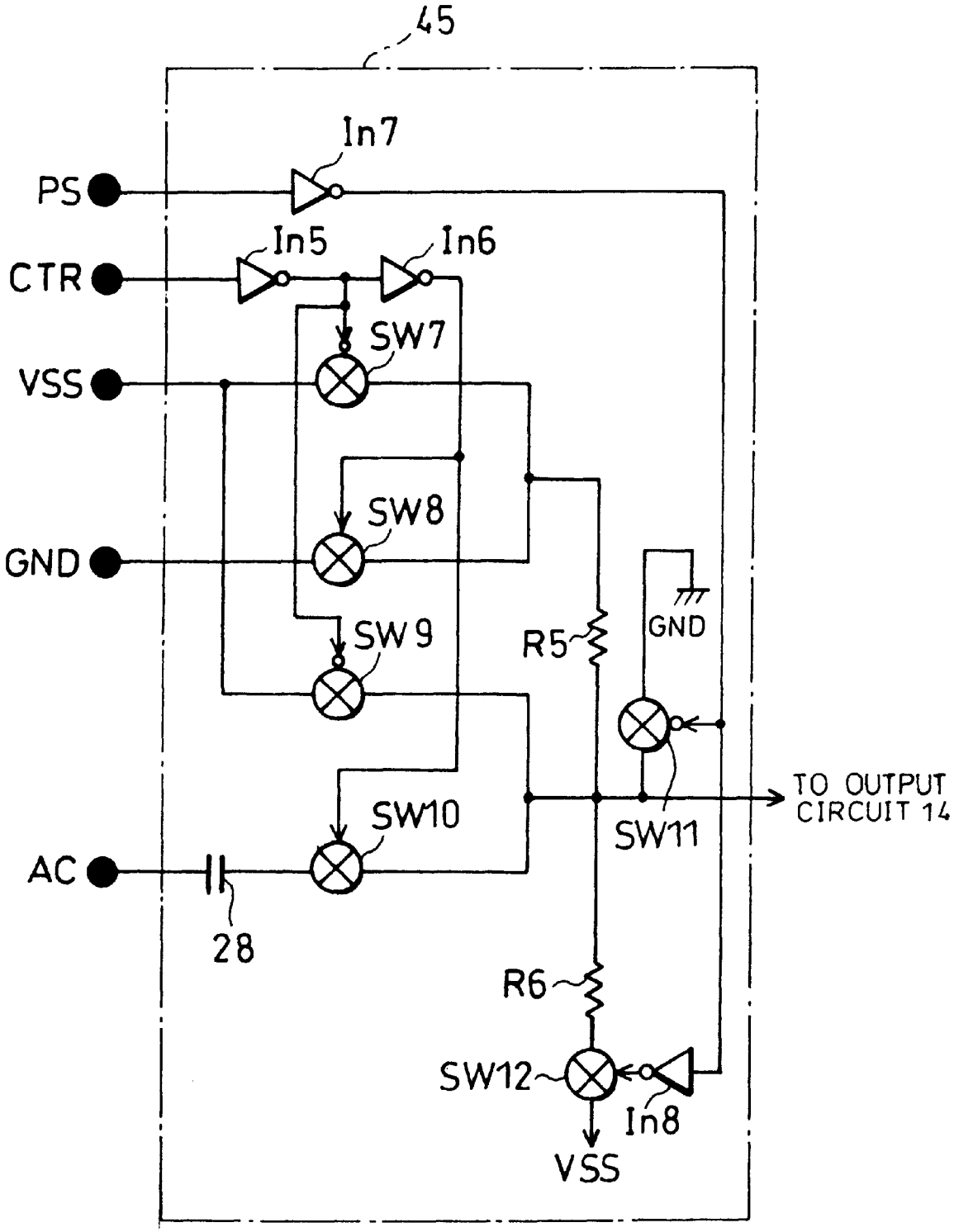
FIG. 13 is a circuit diagram of a switching circuit provided in the gate driver shown in FIG. 12.

The following will explain a further embodiment of the present invention with reference to FIGS. 12 and 13. For ease of explanation, members (structures) having the same functions as those shown in the drawings pertaining to the first through third embodiments above will be given the same reference symbols, and explanation thereof will be omitted here.

A liquid crystal display device according to the present embodiment is provided with a gate driver 43 (driving means), shown in FIG. 12, instead of the gate driver 23 (FIG.

7). Operation of the gate driver 43 is controlled on the basis of various signals supplied by the control circuit 5, such as a clock signal CK and a start pulse signal SP. The gate driver 43 receives a plurality of different voltages from the power circuit 6, and receives the counter electrode signal AC from the counter electrode driving circuit 7. The gate driver 43 supplies signals to the plurality of gate signal lines 8.

The gate driver 43 produces a rectangular wave signal ACK on the basis of the counter electrode signal AC supplied by the counter electrode driving circuit 7. Consequently, in the liquid crystal display device according to the present embodiment, as in the liquid crystal display device 21 above, peripheral circuits can be simplified.

As shown in FIG. 12, the gate driver 43 is provided with a switching circuit 45 (switching means) in place of the switching circuit 25 (FIG. 7). The gate driver 43 is also provided with a power-save setting terminal PS (power consumption reducing means), which stops operation of the voltage generating means when the liquid crystal display device is on stand-by.

As shown in FIG. 13, the switching circuit 45 is made up of a capacitor 28, analog switches SW7 through SW12, inverters In5 through In8, resistor elements R5 and R6, etc. The capacitor 28, provided between the counter electrode driving circuit 7 and the analog switch SW10, performs voltage conversion. The analog switches SW7 through SW12 are, for example, transmission gates made up of a p-channel MOS and an n-channel MOS. The voltage VSS is applied to the analog switches SW7 and SW9. The analog switch SW7 is connected to the output circuit 14 via the resistor element R5, and to the setting terminal CTR via the inverter In5. The analog switch SW9 is connected to the output circuit 14, and to the setting terminal CTR via the inverter In5. The voltage GND is applied to the analog switch SW8, which is connected to the output circuit 14 via the resistor element R5, and to the setting terminal CTR via the inverters InS and In6. A voltage of a level corresponding to the counter electrode signal AC is applied to the analog switch SW10 via the capacitor 28. The analog switch SW10 is connected to the output circuit 14, and to the setting terminal CTR via the inverters In5 and In6. Outputs from the analog switches SW7 through SW10 are voltage divided by the resistor elements R5 and R6 (voltage generating means) and outputted to the output circuit 14.

The analog switch SW11 is connected to the analog switches SW9 and SW10 and to the output circuit 14, and is connected to the analog switches SW7 and SW8 via the resistor element R5. Further, the analog switch SW11 is also connected to the power-save setting terminal PS via the inverter In7, and is grounded (voltage GND). The analog switch SW12 is connected to the analog switches SW9 and SW10 via the resistor element R6, and to the analog switches SW7 and SW8 via the resistor elements R5 and RG. The analog switch SW12 is also connected to the power-save setting terminal PS via the inverters In7 and In8. Further, the power-save setting terminal PS, the analog switches SW11 and SW12, the inverters In7 and In8, etc. make up power-save means (power consumption reducing means). In other words, the switching circuit 45 is structured as the switching circuit 25, with the addition of power-save means.

The remainder of the structural members (structure) of the liquid crystal display device according to the present embodiment are equivalent to those of the liquid crystal display device 21 according to the second embodiment above.

In the foregoing structure, when a voltage of VDD is applied to the power-save setting terminal PS, due to action of the inverters In7 and In8, the analog switch SW12 is selected, and the analog switch SW11 is non-selected. As a result, the switching circuit 45 performs operations equivalent to those of the switching circuit 25 above.

During, for example, stand-by of the liquid crystal display device, on the other hand, when a voltage of VSS is applied to the power-save setting terminal PS, due to action of the inverters In7 and In8, the analog switch SW11 is selected, and the analog switch SW12 is non-selected. As a result, the switching circuit 45 stops generating the rectangular wave signal ACK from the counter electrode signal AC, thus fixing the voltage applied to the output circuit 14 at voltage GND. In this way, since the gate driver 43 stops generating the rectangular wave signal ACK during stand-by of the liquid crystal display device, the power consumed by the operations for generating the signal ACK can be saved. In other words, power consumption can be reduced during stand-by of the liquid crystal display device.

Incidentally, the circuit structure of the switching circuit 45 is not limited to that discussed above; any equivalent circuit structure may be used. Further, the capacitor 28 may be provided between the counter electrode driving circuit 7 and the switching circuit 45 instead of inside the switching circuit 45.

[FIFTH EMBODIMENT]

Figure 14:
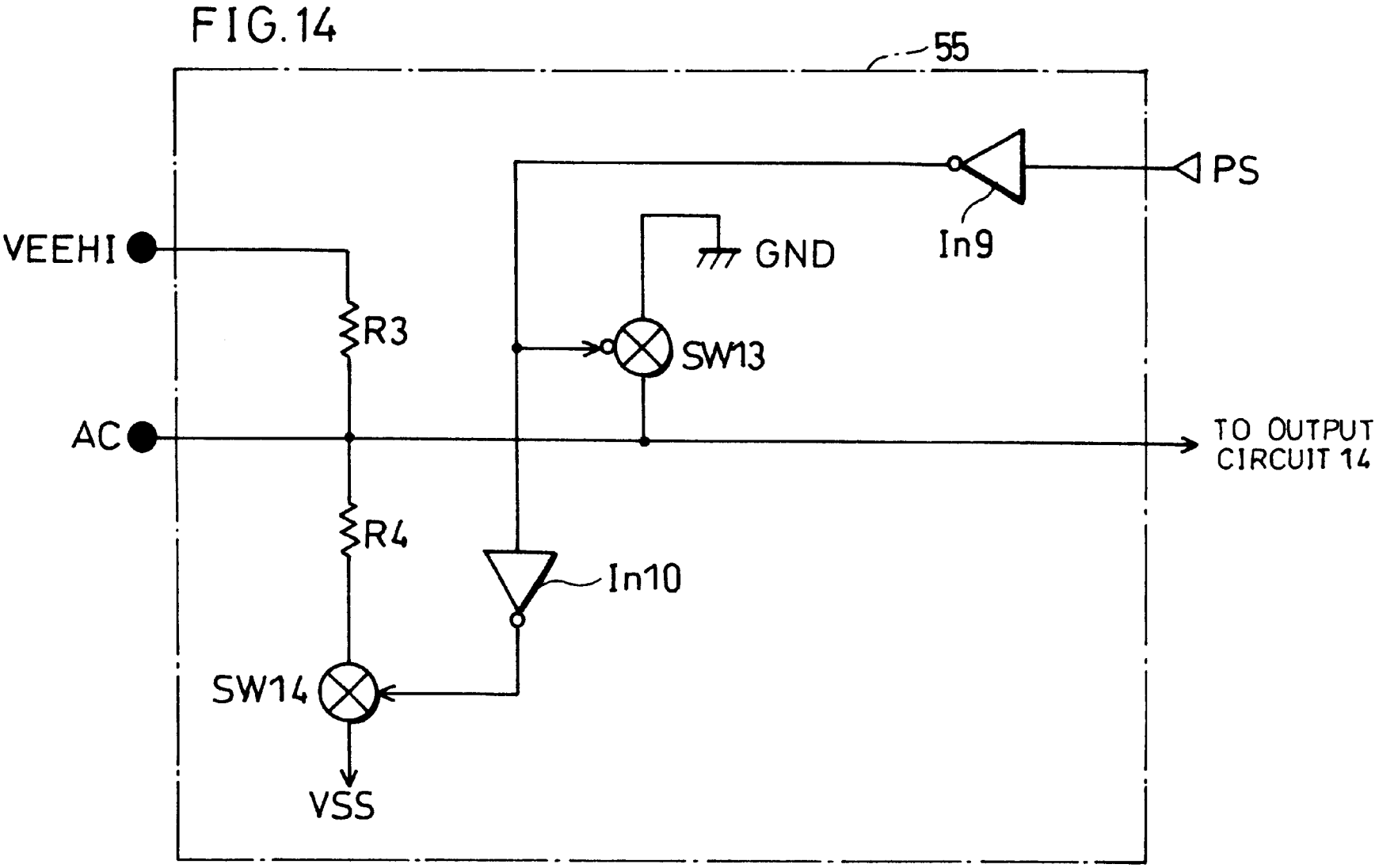
FIG. 14 is a circuit diagram of a switching circuit provided in a gate driver of a liquid crystal display device according to a further embodiment of the present invention.
Figure 15:
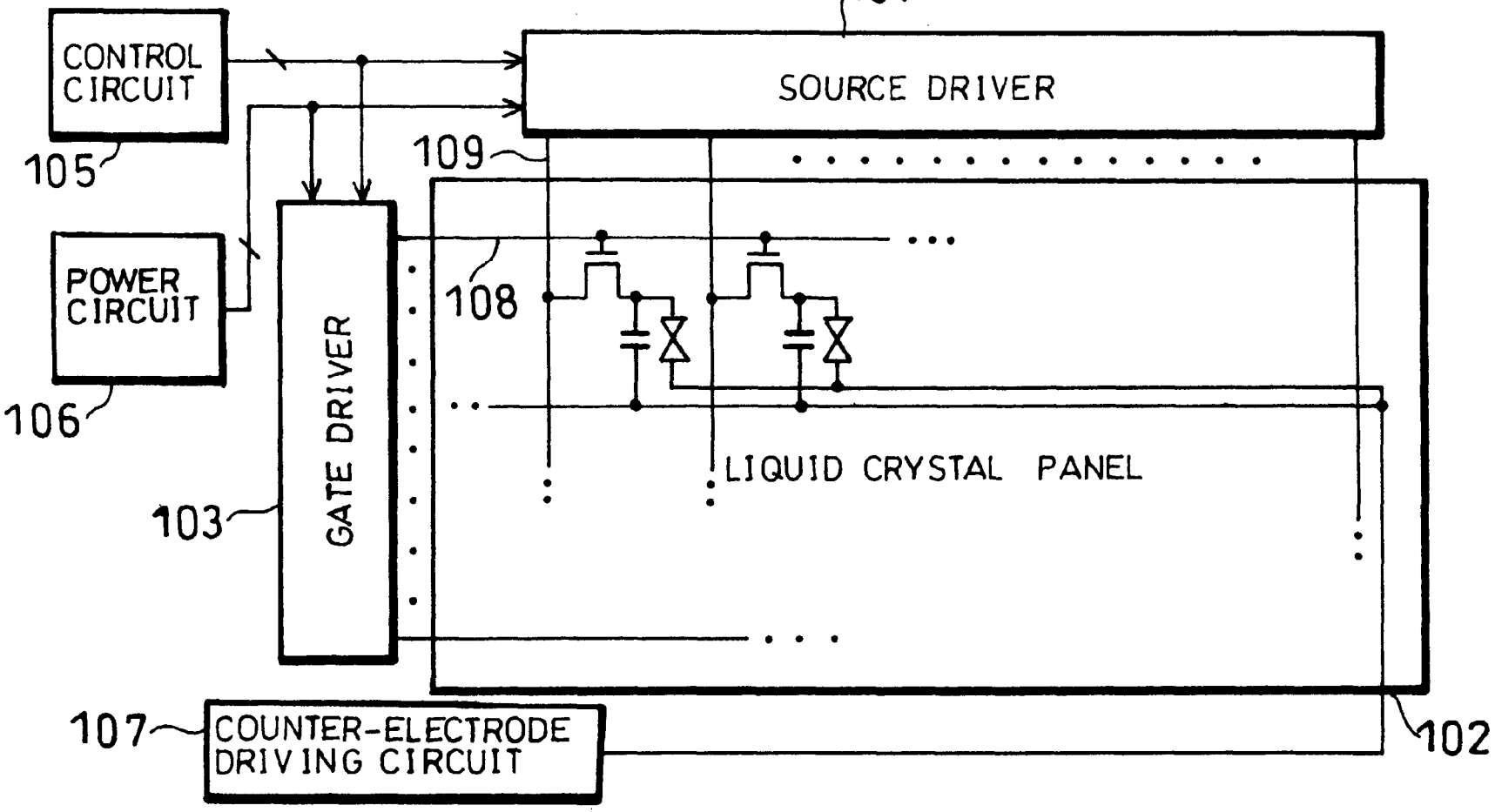
FIG. 15 is a block diagram schematically showing the structure of a conventional liquid crystal display device.
Figure 16:
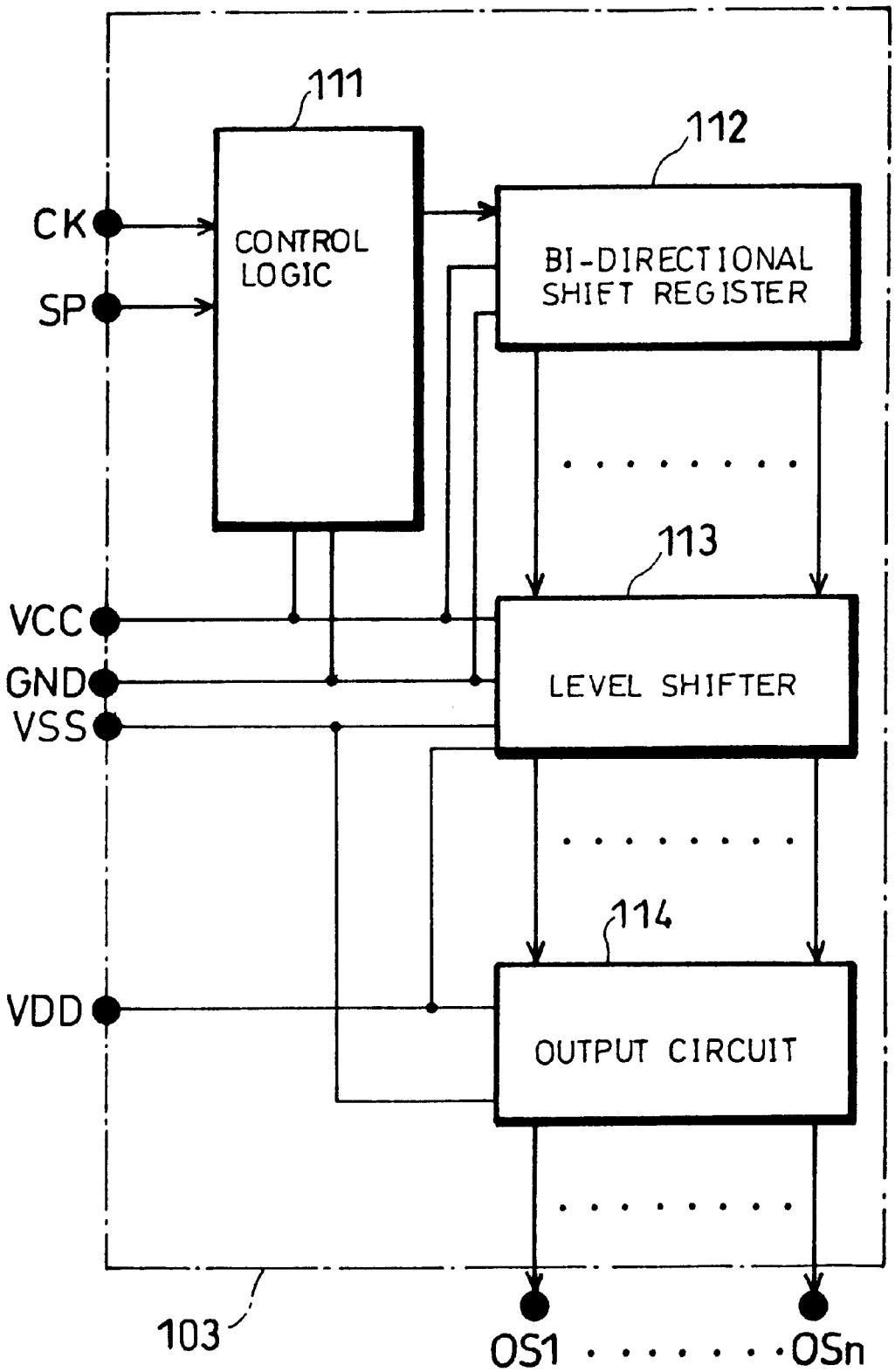
FIG. 16 is a block diagram schematically showing the circuit structure of a gate driver provided in the liquid crystal display device shown in FIG. 15.
Figure 17:
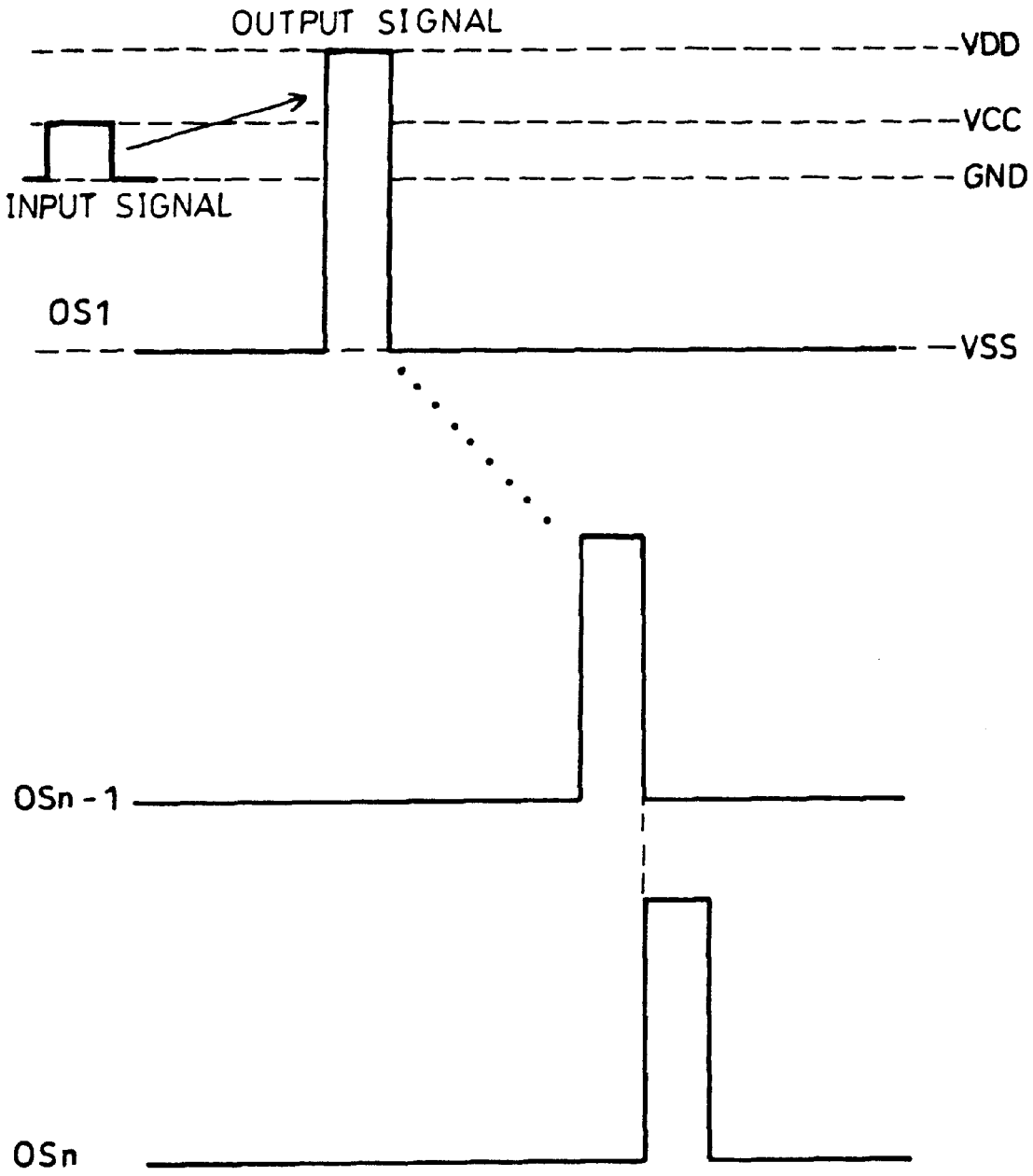
FIG. 17 is a timing chart explaining operation of the gate driver shown in FIG. 16.
Figure 18:
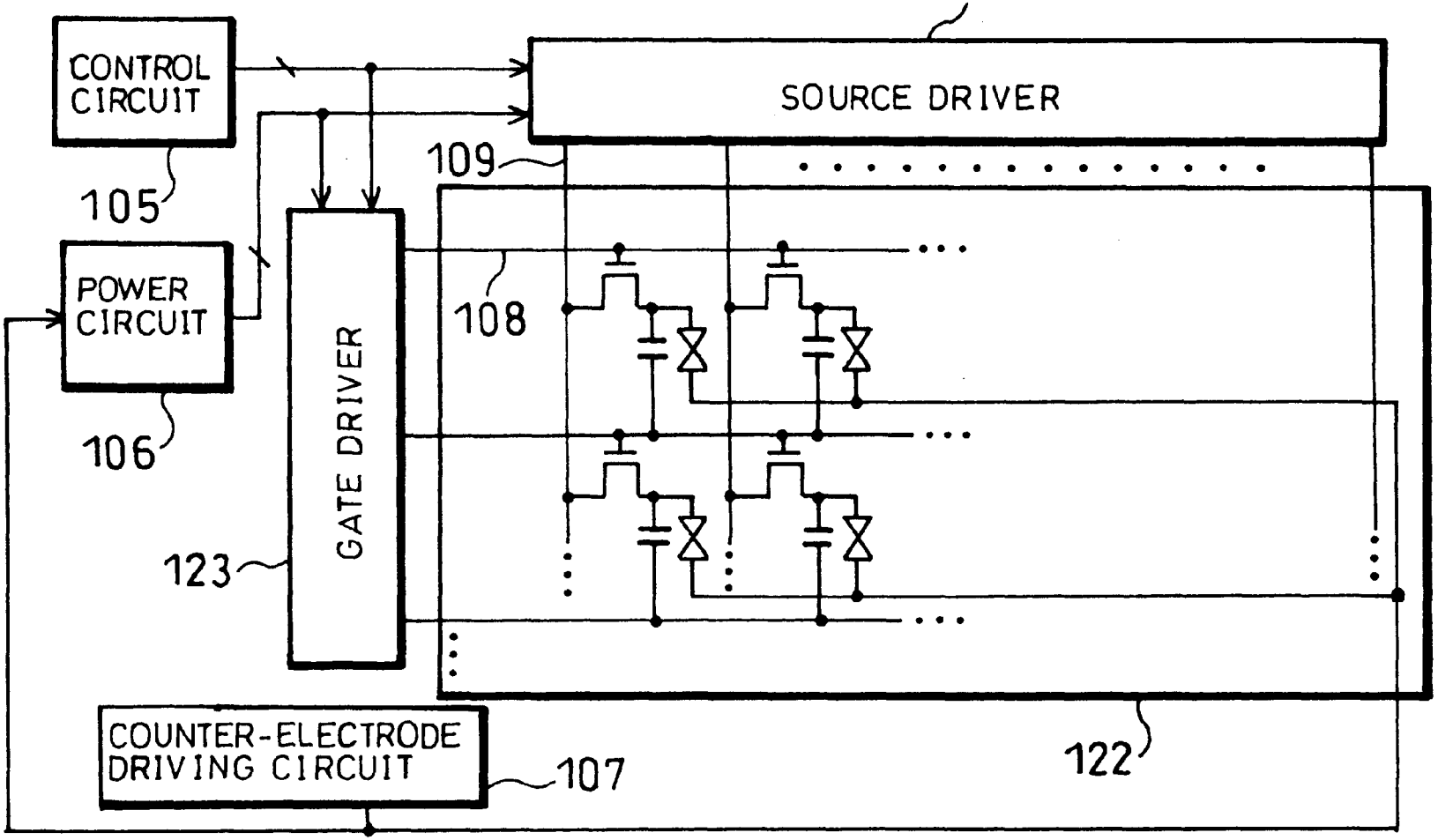
FIG. 18 is a block diagram schematically showing the structure of a conventional liquid crystal display device.
Figure 19:
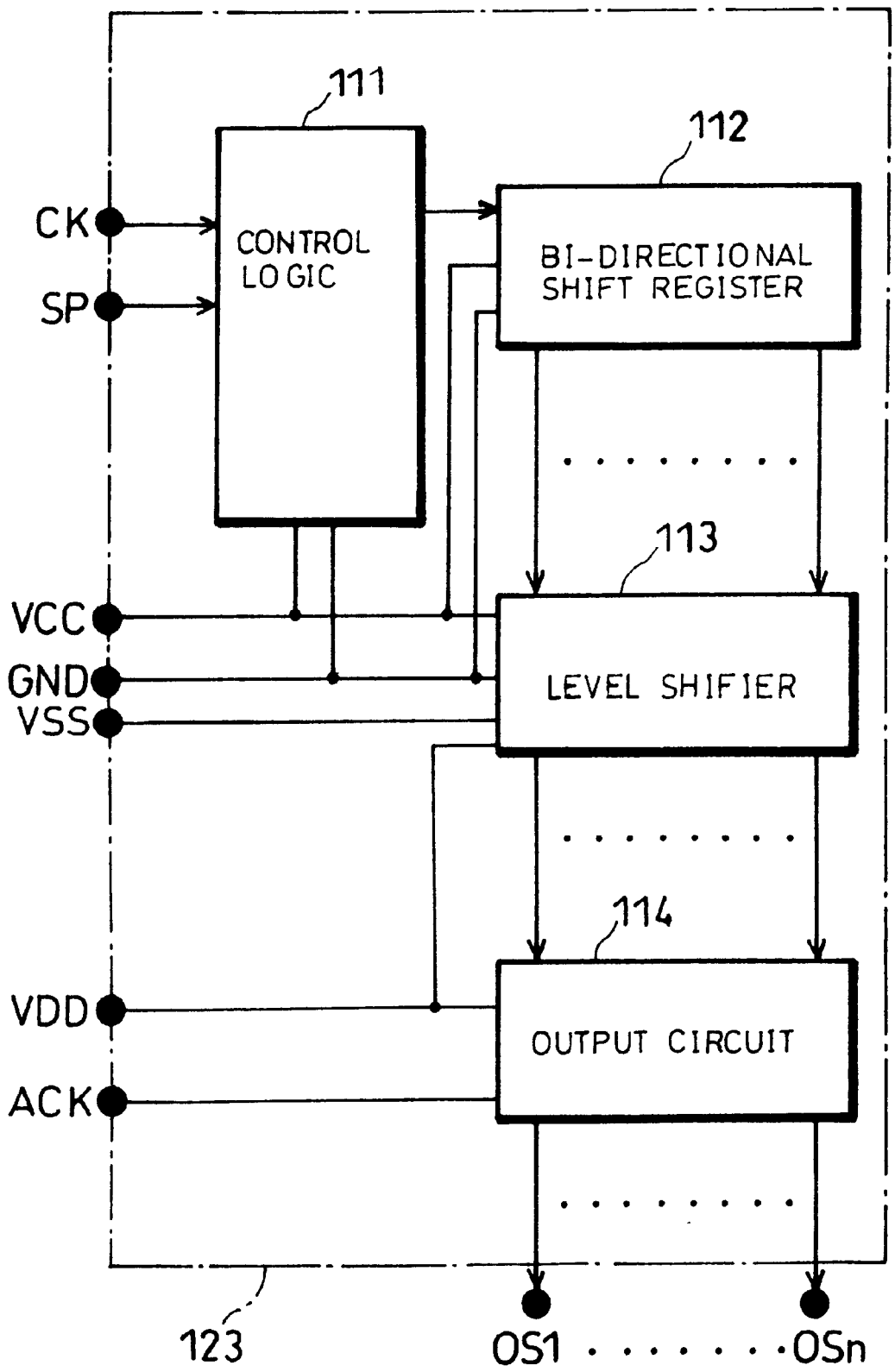
FIG. 19 is a block diagram schematically showing the circuit structure of a gate driver provided in the liquid crystal display device shown in FIG. 18.
Figure 20:
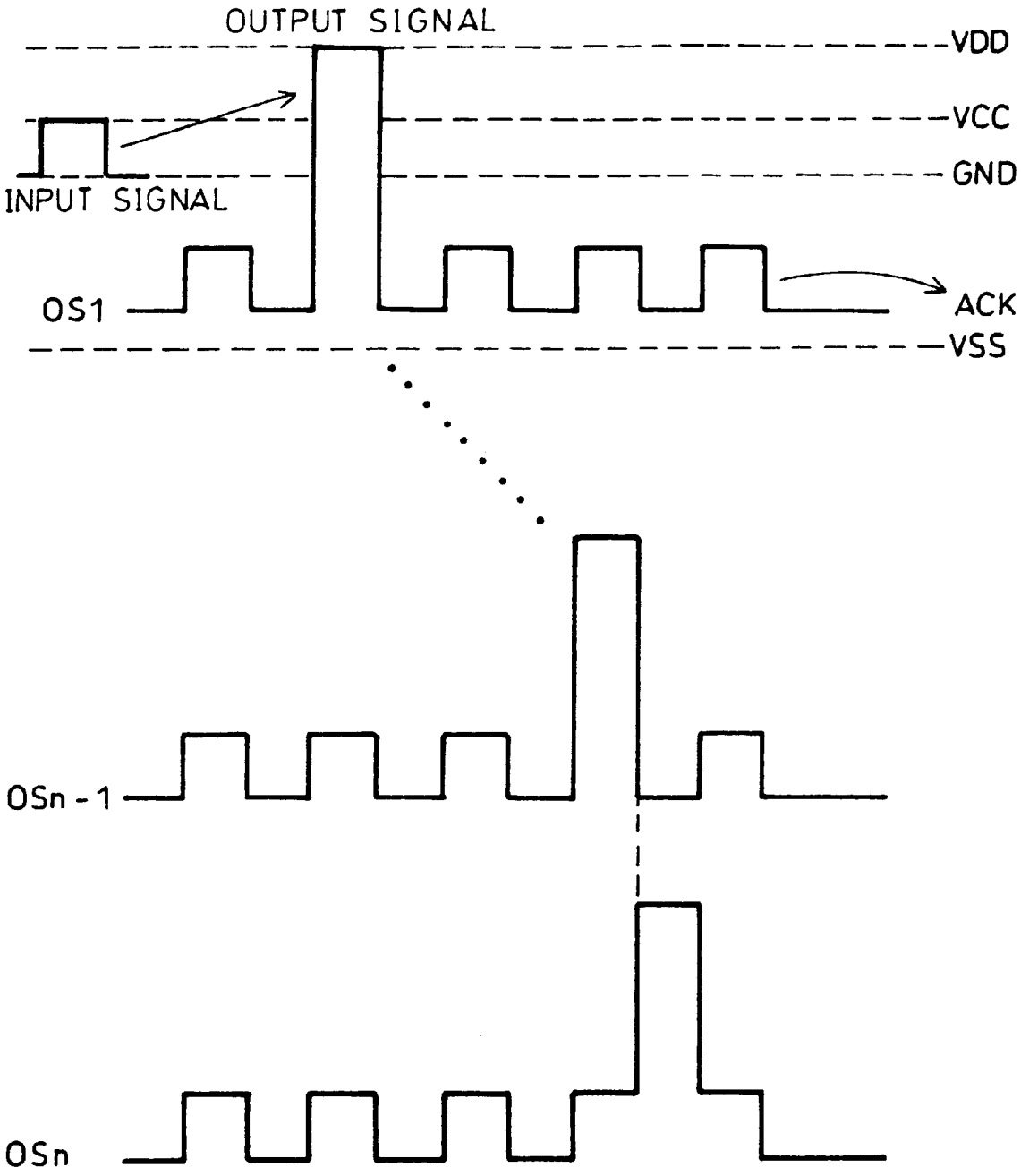
FIG. 20 is a timing chart explaining operation of the gate driver shown in FIG. 19.

The following will explain a further embodiment of the present invention with reference to FIG. 14. For ease of explanation, members (structures) having the same functions as those shown in the drawings pertaining to the first through fourth embodiments above will be given the same reference symbols, and explanation thereof will be omitted here.

In a liquid crystal display device according to the present embodiment, the resistor elements R3 and R4 of the gate driver 33 (FIG. 11) are replaced by a switching circuit 55 (switching means), shown in FIG. 14, which incorporates the resistor elements R3 and R4. Further, the switching circuit 55 is provided with a setting terminal VEEHI, a terminal AC, and a power-save setting terminal PS.

The switching circuit 55 is made up of analog switches SW13 and SW14, inverters In9 and In10, the resistor elements R3 and R4, etc. The analog switches SW13 and SW14 are, for example, transmission gates made up of a p-channel MOS and an n-channel MOS. The analog switch SW13 is connected to the terminal AC and to the output circuit 14, and to the setting terminal VEEHI via the resistor element R3. Further, the analog switch SW13 is also connected to the power-save setting terminal PS via the inverter In9, and is grounded (voltage GND). The analog switch SW14 is connected to the terminal AC and the output circuit 14 via the resistor element R4, and to the setting terminal VEEHI via the resistor elements R3 and R4. Further, the analog switch SW14 is also connected to the power-save setting terminal PS via the inverters In9 and In10. Further, the power-save setting terminal PS, the analog switches SW13 and SW14, the inverters In9 and In10, etc. make up power-save means (power consumption reducing means). In other words, the switching circuit 55 is structured as the resistor elements R3 and R4 (voltage generating means) of the gate driver 33 above, with the addition of power-save means.

The remainder of the structural members (structure) of the liquid crystal display device according to the present embodiment are equivalent to those of the liquid crystal display device according to the third embodiment above.

In the foregoing structure, when a voltage of VDD is applied to the power-save setting terminal PS, due to action of the inverters In9 and In10, the analog switch SW14 is selected, and the analog switch SW13 is non-selected. As a result, the gate driver (driving means) including the switching circuit 55 performs operations equivalent to those of the foregoing gate driver 33.

During, for example, stand-by of the liquid crystal display device, on the other hand, when a voltage of VSS is applied to the power-save setting terminal PS, due to action of the inverters In9 and In10, the analog switch SW13 is selected, and the analog switch SW14 is non-selected. As a result, the switching circuit 55 stops generating the rectangular wave signal ACK from the counter electrode signal AC, thus fixing the voltage applied to the output circuit 14 at voltage GND. In this way, since the gate driver including the switching circuit 55 stops generating the rectangular wave signal ACK during stand-by of the liquid crystal display device, the power consumed by operations for generating the signal ACK can be saved. In other words, power consumption can be reduced during stand-by of the liquid crystal display device.

Incidentally, the circuit structure of the switching circuit 55 is not limited to that discussed above; any equivalent circuit structure may be used.

As discussed above, a liquid crystal display device according to the present invention is made up of driving means capable of driving gate signal lines of display means having auxiliary capacitance electrodes, which form auxiliary capacitances with pixel electrodes, connected to capacitance lines, and capable of driving gate signal lines of display means having auxiliary capacitance electrodes connected to the gate signal lines; and a power source device which applies a voltage to the display means through the driving means; in which the driving means include switching means for changing the voltage applied to the display means from the power source device to enable driving of the gate signal lines in accordance with the structure of the display means.

With this structure, the driving means for driving the gate signal lines include switching means, which change the voltage applied to the display means from the power source device in accordance with the structure of the display means. In this way, by providing the driving means with switching means which change the voltage applied from the power source device so as to be compatible with both the Cs-on-common and Cs-on-gate structures, the liquid crystal display device according to the present invention, using a single driving means, can perform gate signal line driving which is in accordance with the structure of the display means. Consequently, it is not necessary to provide the liquid crystal display device with two kinds of driving means and switch back and forth between them depending on the structure of the display means. Accordingly, the process for manufacturing the liquid crystal display device can be simplified, and versatility of the liquid crystal display device can be improved.

Further, the liquid crystal display device according to the present invention is preferably structured as above, further provided with voltage generating means for generating a voltage for AC driving of gate signal lines of display means having auxiliary capacitance electrodes connected to the gate signal lines.

In this way, by providing, for example, the power source device or the switching means with voltage generating means for generating a voltage for AC driving of gate signal lines of display means of the Cs-on-gate structure, the liquid crystal display device according to the present invention, using a single driving means, can apply voltages and perform gate signal line driving which is in accordance with the structure of the display means. Consequently, it is not necessary to provide the liquid crystal display device with two kinds of driving means and switch back and forth between them depending on the structure of the display means. Accordingly, the process for manufacturing the liquid crystal display device can be simplified, and versatility of the liquid crystal display device can be improved.

Moreover, when the foregoing voltage generating means are provided in the switching means, the power source device, which is a peripheral device (circuit), can be streamlined, thus contributing to miniaturization of the liquid crystal display device in cases when portability of the liquid crystal display device is highly desirable.

Further, the liquid crystal display device according to the present invention is preferably structured as above, further provided with power consumption reducing means for stopping operation of the voltage generating means during stand-by of the liquid crystal display device.

By providing the liquid crystal display device according to the present invention with power consumption reducing means, operation of the voltage generating means can be stopped during stand-by. Accordingly, the power consumed by operation of the voltage generating means can be saved, thus reducing the power consumption of the liquid crystal display device during stand-by.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations, provided such variations do not depart from the spirit of the present invention or exceed the scope of the patent claims set forth below.

What is claimed is:

1. A liquid crystal display device comprising:

driving means for driving gate signal lines of display means, the driving means capable of being used with both a display means having a first structure and a display means having a second structure, the display means having the first structure including auxiliary capacitance electrodes forming auxiliary capacitances with pixel electrodes connected to capacitance lines, the display means having the second structure including auxiliary capacitance electrodes connected to the gate signal lines; and a power source device for applying a voltage to the display means through said driving means;

wherein said driving means includes switching means for changing the voltage applied to the display means from said power source device, to enable driving of the gate signal lines in accordance with the structures of the display means, wherein the switching means is capable of being used with both the display means having said first structure and the display means having said second structure.

2. The liquid crystal display device according to claim 1, further comprising:

voltage generating means for generating a voltage for AC driving of gate signal lines of the display means having said second structure in which the auxiliary capacitance electrodes are connected to the gate signal lines.

3. The liquid crystal display device according to claim 2, wherein:

said voltage generating means are provided in said power source device.

4. The liquid crystal display device according to claim 3, wherein:

said switching means receive input of a voltage for driving gate signal lines of the display means having said first structure and a voltage generated by said voltage generating means, and selectively output the voltages in accordance with whether the display means have said first or said second structure.

5. The liquid crystal display device according to claim 4, wherein said switching means comprise:

a setting section for selecting the voltage to be applied to the display means;

a first analog switch which receives input of the voltage for driving gate signal lines of the display means having said first structure; and a second analog switch which receives input of the voltage generated by said voltage generating means;

wherein the voltage to be applied to the display means is selected by switching said first and second analog switches on the basis of setting of said setting section.

6. The liquid crystal display device according to claim 2, wherein:

said voltage generating means are provided in said driving means.

7. The liquid crystal display device according to claim 6, wherein:

said voltage generating means are provided in said switching means.

8. The liquid crystal display device according to claim 7, wherein:

said voltage generating means generate a voltage for AC driving of gate signal lines of the display means having said second structure based on a counter electrode signal for application to a counter electrode of the display means.

9. The liquid crystal display device according to claim 8, wherein:

said voltage generating means include a capacitor and voltage-dividing resistor elements.

10. The liquid crystal display device according to claim 2, wherein:

said switching means include power consumption reducing means for stopping operation of said voltage generating means during stand-by of said liquid crystal display device.

* * * * *